US012317960B2

(12) United States Patent
Hatfield et al.

(10) Patent No.: US 12,317,960 B2
(45) Date of Patent: Jun. 3, 2025

(54) REAR ACCESS ARTICLE OF FOOTWEAR WITH MOVABLE HEEL PORTION

(71) Applicant: NIKE, Inc., Beaverton, OR (US)

(72) Inventors: Tinker L. Hatfield, Portland, OR (US); Tiffany A. Beers, Portland, OR (US); John T. Dimoff, Portland, OR (US); Jared M. Kilmer, Vancouver, WA (US); Kevin J. Rucier, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/317,478

(22) Filed: May 15, 2023

(65) Prior Publication Data

US 2023/0276892 A1 Sep. 7, 2023

Related U.S. Application Data

(63) Continuation of application No. 17/502,371, filed on Oct. 15, 2021, now Pat. No. 11,684,109, which is a (Continued)

(51) Int. Cl.

| | |
|---|---|
| ***A43B 3/24*** | (2006.01) |
| ***A43B 1/00*** | (2006.01) |
| ***A43B 11/00*** | (2006.01) |

(52) U.S. Cl.

CPC ..... *A43B 3/248* (2013.01); *A43B 1/0054* (2013.01); *A43B 3/24* (2013.01); *A43B 3/242* (2013.01); *A43B 3/244* (2013.01); *A43B 11/00* (2013.01)

(58) Field of Classification Search

CPC ..... A43B 3/248; A43B 3/24; A43B 3/242; A43B 1/0054; A43B 3/244; A43B 11/00; A43B 23/0295; A43C 11/008

See application file for complete search history.

(56) References Cited

U.S. PATENT DOCUMENTS

| | | | | |
|---|---|---|---|---|
| 2011/0146106 | A1* | 6/2011 | Kaufman | A43C 11/00 36/43 |
| 2012/0079746 | A1* | 4/2012 | Ferreira | A43C 1/02 36/105 |

(Continued)

FOREIGN PATENT DOCUMENTS

| | | | | |
|---|---|---|---|---|
| AU | 2010202361 | A1 | 7/2010 | |
| CN | 105658105 | A | 6/2016 | |
| KR | 20100103909 | A * | 9/2010 | A43B 3/242 |

*Primary Examiner* — Aiying Zhao

(74) *Attorney, Agent, or Firm* — Quinn IP Law

(57) ABSTRACT

An article of footwear comprises a sole structure, and an upper including a front section and a rear section. The front section is fixed to a forefoot region of the sole structure and partially defines a foot-receiving cavity. The rear section is operatively secured to the sole structure at least partially rearward of the front section, and includes medial and lateral wings. A medial set of magnets includes at least one front medial magnet secured to a medial side of the front section and at least one rear medial magnet secured to the medial wing. A lateral set of magnets includes at least one front lateral magnet secured to a lateral side of the front section and at least one rear lateral magnet secured to the lateral wing. The rear section is movable relative to the front section between an access position and a use position.

19 Claims, 10 Drawing Sheets

Related U.S. Application Data continuation of application No. 15/970,265, filed on May 3, 2018, now Pat. No. 11,172,727.

(60) Provisional application No. 62/510,038, filed on May 23, 2017.

(56) References Cited

U.S. PATENT DOCUMENTS

| | | | | |
|---|---|---|---|---|
| 2012/0186017 | A1 | 7/2012 | Riach | |
| 2014/0096415 | A1* | 4/2014 | Long | A61K 31/401 36/105 |
| 2014/0338225 | A1* | 11/2014 | Bliss | A43B 11/00 36/83 |
| 2015/0216252 | A1* | 8/2015 | Wiens | A43B 1/0054 36/105 |
| 2018/0213882 | A1* | 8/2018 | Morse | A43B 23/0295 |
| 2018/0295942 | A1* | 10/2018 | Drake | A43C 11/004 |
| 2018/0325208 | A1* | 11/2018 | Delaney | A43B 3/122 |

* cited by examiner

REAR ACCESS ARTICLE OF FOOTWEAR WITH MOVABLE HEEL PORTION

CROSS-REFERENCE AND CLAIM OF PRIORITY TO RELATED APPLICATIONS

This application is a continuation of U.S. patent application Ser. No. 17/502,371, which was filed on Oct. 15, 2021, is now allowed, and is a continuation of U.S. patent application Ser. No. 15/970,265, which was filed May 3, 2018, is now U.S. Pat. No. 11,172,727 B2, and claims priority to U.S. Provisional App. No. 62/510,038, which was filed May 23, 2017. All of the foregoing applications are incorporated by reference in their respective entireties and for all purposes.

TECHNICAL FIELD

The present teachings relate to an article of footwear having an upper with a rear section that moves by articulating or otherwise relative to a sole structure and/or a front section of the upper.

BACKGROUND

Traditionally, placing footwear on a foot often requires the use of one or both hands to stretch the ankle opening of an upper, and hold the rear portion during foot insertion. The fit of the upper is then adjusted following foot insertion, such as by tying laces.

DESCRIPTION

Figure 1:
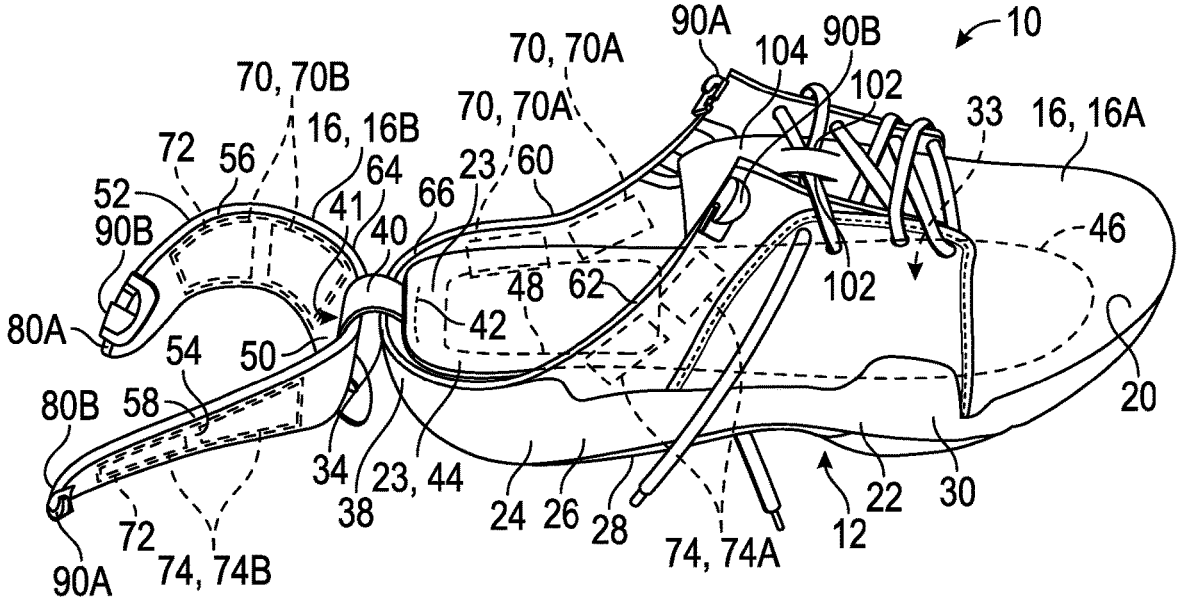
FIG. 1 is a schematic perspective view of an article of footwear with a rear section of an upper in an access position.

An article of footwear has an upper that enables hands-free foot entry into the article of footwear, and includes magnets for hands-free coupling of the article of footwear to the foot. The article of footwear can then be further secured to the foot manually with lace guides and a lace. Within the scope of the present disclosure, the article of footwear comprises a sole structure, and an upper including a front section and a rear section. The front section is fixed to a forefoot region of the sole structure and partially defines a foot-receiving cavity. The rear section is operatively secured to the sole structure at least partially rearward of the front section, and includes a medial wing and a lateral wing. A medial set of magnets includes at least one front medial magnet secured to a medial side of the front section and at least one rear medial magnet secured to the medial wing. A lateral set of magnets includes at least one front lateral magnet secured to a lateral side of the front section and at least one rear lateral magnet secured to the lateral wing.

The rear section is movable relative to the front section between an access position and a use position. In the access position, the medial wing and the lateral wing are spaced apart from the sole structure with a distal end of the medial wing and a distal end of the lateral wing both remote from the sole structure and further apart from one another than in the use position. In the use position, the distal end of the medial wing is adjacent to the front section with the at least one rear medial magnet coupled to the at least one front medial magnet and the distal end of the lateral wing is adjacent to the front section with the at least one rear lateral magnet coupled to the at least one front lateral magnet. In embodiments with multiple front and rear medial magnets and multiple front and rear lateral magnets, the magnets may attract rearward to forward in a zipper-like fashion to help move the rear section to the use position. Accordingly, the article of footwear with the divided upper portion may enable hands-free foot entry in the access position, while the magnetically coupled front and rear upper sections secure the foot in the use position.

Lace guides and a lace may further secure the rear section to the front section in the use position. More specifically, in an embodiment, the article of footwear may further comprise at least a first portion of a lace guide secured to the medial wing or the lateral wing. In an embodiment, both the medial wing and the lateral wing have at least a first portion of a lace guide secured thereto. In some embodiments, the lace guide is a unitary component. In other embodiments, the lace guide is a split lace guide, with the first portion of the lace guide secured to the medial wing or the lateral wing, and a second portion of the lace guide secured to the front section. The first portion and the second portion are spaced apart from one another when the rear section is in the access position and are adjacent to one another when the rear section is in the use position. The first portion of the lace guide protrudes outwardly from an outer surface of the medial wing or the lateral wing. Each of the first portion and the second portion may include a hook. The hook of the first portion is in direct contact with the hook of the second portion when the rear section is in the use position. The cavity defined by the first portion of the lace guide is disposed outside the medial wing or the lateral wing. The lace guide may include a first hook portion and a second hook portion. The first hook portion and the second hook portion are in direct contact with one another when the rear section is in the use position.

The split lace guide may utilize magnets to help couple the portions to one another in the use position. For example, the first portion of the lace guide and the second portion of the lace guide may each define a cavity, and the article of footwear may further comprise a first magnet in the cavity of the first portion, and a second magnet in the cavity of the second portion. An end of the first magnet adjacent to an end of the second magnet in the use position has an opposite polarity from the end of the second magnet.

In an embodiment, the article of footwear may further comprise a plurality of lace-receiving elements on the front section, and a lace extending through at least some of the plurality of the lace receiving elements and around the at least a portion of the lace guide when the rear section is in the use position. In this manner, the lace both tightens the front section, and helps secure the rear section to the front section via the lace guide.

In an embodiment, the article of footwear further comprises a magnet housing defining at least one cavity. The magnet housing is embedded in the medial wing or the lateral wing. A respective one of the at least one rear medial magnet and the at least one rear lateral magnet is in the at least one cavity.

In different embodiments, the front and rear medial and lateral sets of magnets can interface in different manners. For example, in an embodiment, a lower edge of the medial wing abuts a medial edge of the front section in the use position, and a lower edge of the lateral wing abuts a lateral edge of the front section in the use position. The at least one front medial magnet is disposed at the medial edge of the front section, the at least one rear medial magnet is disposed at the lower edge of the medial wing, the at least one front lateral magnet is disposed at the lateral edge of the front section, and the at least one rear lateral magnet is disposed at the lower edge of the lateral wing. The edges of the rear section rest on the edges of the front section in the use position, with the front and rear magnets coupled to one another at the edges.

Alternatively, the front and rear magnets can overlap in the use position. In an embodiment, the at least one front medial magnet is arranged adjacent to an outer surface of the front section, the at least one rear medial magnet is arranged adjacent to an inner surface of the medial wing, the at least one front lateral magnet is arranged adjacent to the outer surface of the front section, and the at least one rear lateral magnet is arranged adjacent to an inner surface of the lateral wing. The inner surface of the medial wing overlaps the outer surface of the front section in the use position, and the inner surface of the lateral wing overlaps the outer surface of the front section in the use position.

In an embodiment, the rear section of the upper includes a bistable heel portion with a folded state in the access position, and an unfolded state in the use position. The bistable heel portion has a fold between the medial wing and the lateral wing in the folded state. The fold is unfolded when the bistable heel portion is in the unfolded state.

In some embodiments, the article of footwear is configured so that foot entry helps move the rear section to the use position. For example, within the scope of the present disclosure, an article of footwear comprises a sole structure, and an upper including a front section and a separate rear section. The front section is fixed to a forefoot region of the sole structure and partially defines a foot-receiving cavity. The rear section is rearward of the front section and includes a medial wing and a lateral wing. An insole is positioned within the foot-receiving cavity. A support extends upward at a rear of the midsole. A tether couples the insole to the rear section. The rear section articulates relative to the front section between an access position and a use position. The medial wing and the lateral wing are spaced apart from the front section in the access position. In the use position, the medial wing is adjacent to the front section, and the lateral wing is adjacent to the front section. A rear of the insole is in a lifted position when the rear section is in the access position. The insole pulls the tether, which moves the rear section from the access position to the use position when the insole is displaced downward in the foot-receiving cavity relative to the lifted position (e.g., under the weight of the foot). The tether extends upwardly toward the support, over the support, and downwardly away from the support when the rear section is in the access position. The support is positioned to act as a fulcrum, across an upper edge of which the tether slides while pulling the rear section from the access position to the use position, causing a pivoting movement of the tether and the insole. The support is discrete from the outsole.

The article of footwear may include a fastener that couples the front section to the rear section when the rear section is in the use position. For example, in an embodiment, the fastener comprises a medial set of magnets and a lateral set of magnets. The medial set of magnets includes at least one front medial magnet secured to a medial side of the front section and at least one rear medial magnet secured to the medial wing. The lateral set of magnets includes at least one front lateral magnet secured to a lateral side of the front section and at least one rear lateral magnet secured to the lateral wing. At least a portion of the fastener is directly coupled to the support.

In an embodiment, the article of footwear further comprises a magnet housing defining at least one cavity. The magnet housing is embedded in the medial wing or the lateral wing, and a respective one of the at least one rear medial magnet and the at least one rear lateral magnet is in the at least one cavity.

In an embodiment, a lower edge of the medial wing abuts a medial edge of the front section in the use position, and a lower edge of the lateral wing abuts a lateral edge of the front section in the use position. The at least one front medial magnet is disposed at the medial edge of the front section, the at least one rear medial magnet is disposed at the lower edge of the medial wing, the at least one front lateral magnet is disposed at the lateral edge of the front section, and the at least one rear lateral magnet is disposed at the lower edge of the lateral wing.

In an embodiment, the article of footwear further comprises a support extending upward at a rear of the sole structure. The tether overlays the support when the rear section is in the access position. The support may be one or more of a rear periphery of the front section, a rear upper edge of the sole structure, or a portion of a heel counter.

The medial and lateral sets of magnets thus couple the rear section to the front section in a hands-free manner. To further secure the rear section to the front section, the article of footwear can be configured so that a lace secured on the front section can secure to one or more lace guides on the front section, or one or more split lace guides. In an embodiment, the article of footwear further comprises at least a first portion of a lace guide secured to the medial wing or the lateral wing. The entire lace guide can be secured on the rear section, or, in an embodiment with a split lace guide, a second portion of the lace guide is secured to the front section. The first portion and the second portion are spaced apart from one another when the rear section is in the access position, and are adjacent to one another when the rear section is in the use position.

In an embodiment, the first portion of the lace guide and the second portion of the lace guide each define a cavity. The article of footwear further comprises a first magnet in the cavity of the first portion, and a second magnet in the cavity of the second portion. An end of the first magnet is adjacent to an end of the second magnet when the rear section is in the use position, and the end of the first magnet has a polarity opposite from a polarity of the end of the second magnet.

In an embodiment, the article of footwear further comprises a plurality of lace-receiving elements on the front section, and a lace extending through at least some of the plurality of the lace receiving elements and around the first portion of the lace guide when the rear section is in the use position.

In an embodiment, the article of footwear further comprises a stiffening component secured to a heel region of the insole. The insole has a first stiffness and the stiffening component has a second stiffness greater than the first stiffness. The stiffening component thus helps stiffen the insole to promote movement of the insole downwardly and in some embodiments forwardly in the foot-receiving cavity when a foot is received thereon, aiding in pulling the tether over the support and moving the rear section from the access position to the use position.

In an embodiment, the tether is secured to an inner surface of the rear section, and a distal end of the medial wing and a distal end of the lateral wing are rearward of the tether in the access position, and forward of the tether in the use position.

In an embodiment, the article of footwear further comprises a hinge connecting the rear section to the front section. The tether extends across the hinge when the rear section is in the access position.

The above features and advantages and other features and advantages of the present teachings are readily apparent from the following detailed description of the modes for carrying out the present teachings when taken in connection with the accompanying drawings.

Referring to the drawings, wherein like reference numbers refer to like components throughout the views, FIGS. 1-5 show an embodiment of an article of footwear 10. An article of footwear may also be referred to as footwear or as a footwear article of manufacture. An article of footwear, a footwear article of manufacture, and footwear may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to in either the singular or plural as 'article(s) of footwear' in this specification, and the claims as filed and/or amended hereinafter.

The article of footwear 10 includes a sole structure 12 and an upper 16. The upper 16 includes a front section 16A and a separate rear section 16B. In the embodiment of FIGS. 1-5, the sections 16A, 16B are configured to cooperate so that the rear section 16B moves from an access position (FIG. 1) to a use position (FIG. 2) upon foot entry in a hands-free manner. As discussed herein, these and other features of the article of footwear 10 enable the access position to afford easy, hands-free foot entry into the article of footwear 10, and enable the footwear 10 to adopt a use position after foot entry, also in a hands-free manner. The use position is maintained via interfacing sets of magnets 70, 74, and via a lace 100 and lace guides 82 that further secures the rear section 16B to the front section 16A.

The footwear 10 and other articles of footwear disclosed herein are depicted as leisure shoes or athletic shoes, but the present teachings also include an article of footwear that is a dress shoe, a work shoe, a sandal, a slipper, a boot, or any other category of footwear.

As indicated in FIG. 1, the footwear 10 may be divided into three general regions: a forefoot region 20, a midfoot region 22, and a heel region 24 which are also the forefoot region, the midfoot region, and the heel region, respectively, of the sole structure 12 and the upper 16. The forefoot region 20 generally includes portions of the article of footwear 10 corresponding with the toes and the joints connecting the metatarsals with the phalanges. The midfoot region 22 generally includes portions of the article of footwear 10 corresponding with the arch area of the foot, and the heel region 24 corresponds with rear portions of the foot, including the calcaneus bone.

The sole structure 12 includes an insole 23, a midsole 26 and an outsole 28. The midsole 26 may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, the midsole 26 may incorporate fluid-filled chambers, plates, moderators, or other elements that further attenuate forces, enhance stability, or influence the motions of the foot. The midsole 26 is depicted as a single, one-piece midsole, but in other embodiments could be multiple components integrated as a unit. In some embodiments, the midsole 26 may be integrated with the outsole 28 as a unisole. The outsole 28 may be one-piece, or may be several outsole components, and may be formed from a wear-resistant rubber material that may be textured to impart traction and/or may include traction elements such as cleats secured to a bottom surface of the midsole 26.

The insole 23 is positioned within a foot-receiving cavity 33 of the footwear 10, above a foot-facing surface 29 of the midsole 26 (best shown in FIG. 5), so that it is supported on the foot-facing surface 29 when the rear section 16B is in the use position described herein. When the rear section 16B is in the access position of FIG. 1, a rear of the insole 23 is lifted in the foot-receiving cavity 33 further above the foot-facing surface 29 than when in the use position. At least the heel portion of the insole 23 is not fixed to the midsole 26. In the embodiment shown, the entire insole 23 is not fixed to the midsole 26. The insole 23 moves downward and may slide forward across the foot-facing surface 29 as further described herein when a foot is inserted in the foot-receiving cavity 33. As further discussed herein, downward movement of the insole 23 causes the rear section 16B to move from the access position to the use position. The foot-facing surface 29 of the midsole 26 may be covered by a strobel secured to the front section 16A, in which case the insole 23 rests on the strobel in the use position, rather than directly on the foot-facing surface 29. When resting on the strobel, the insole 23 is indirectly supported by the midsole 26.

The footwear 10 has a lateral side 30 and a medial side 32 (best shown in FIG. 4) opposite to the lateral side 30. The lateral side 30 and medial side 32 extend through each of forefoot region 20, the midfoot region 22, and the heel region 24 and correspond with opposite sides of the article of footwear 10. The forefoot region 20, the midfoot region 22, the heel region 24, the lateral side 30 and the medial side 32 are not intended to demarcate precise areas of footwear 10, but are instead intended to represent general areas of footwear 10 to aid in the following discussion.

Figure 4:
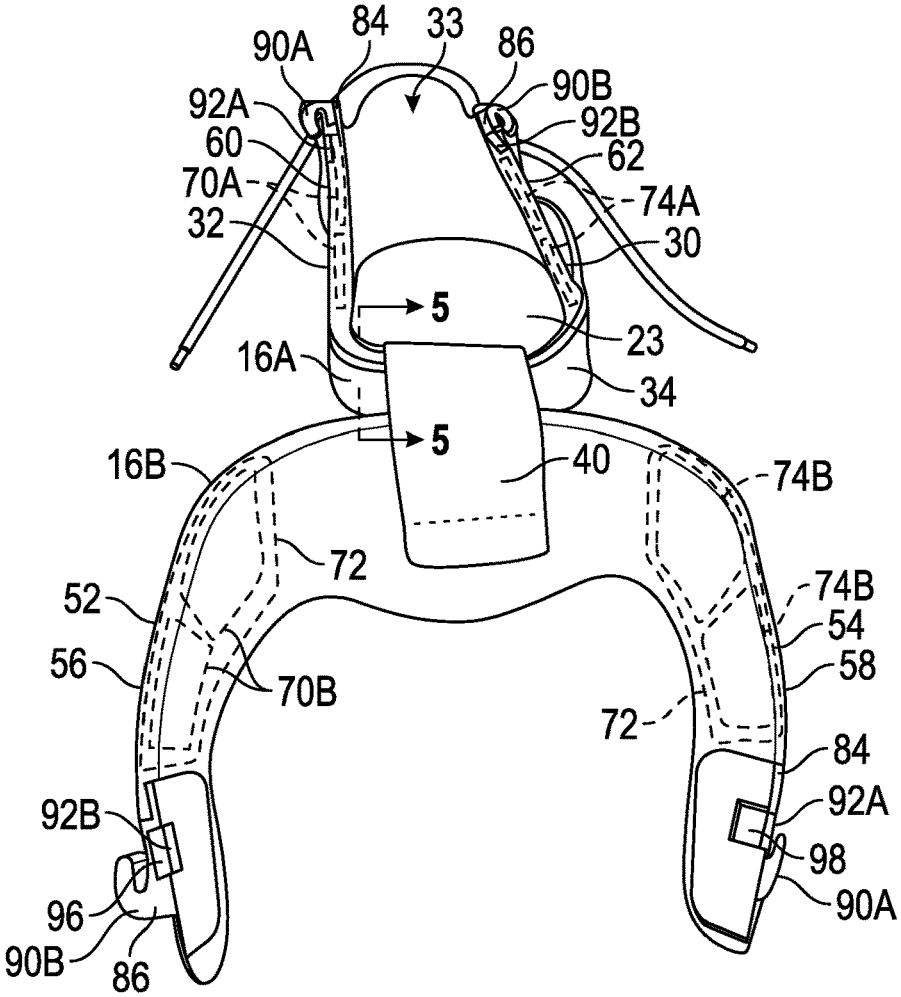
FIG. 4 is a schematic perspective rear view of the article of footwear of FIG. 1 with the rear section in the access position.
Figure 5:
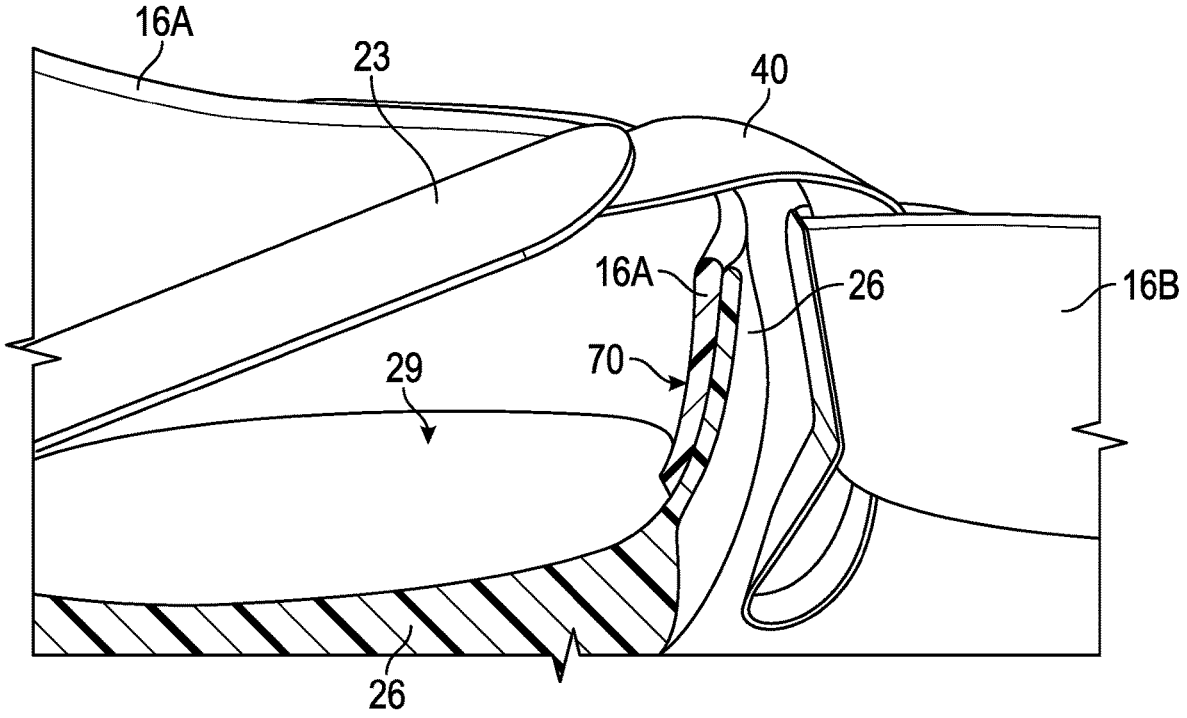
FIG. 5 is a schematic fragmentary and partial cross-sectional view of the article of footwear of FIG. 1 taken at lines 5-5 in FIG. 4, with the rear section in the access position.
Figure 6:
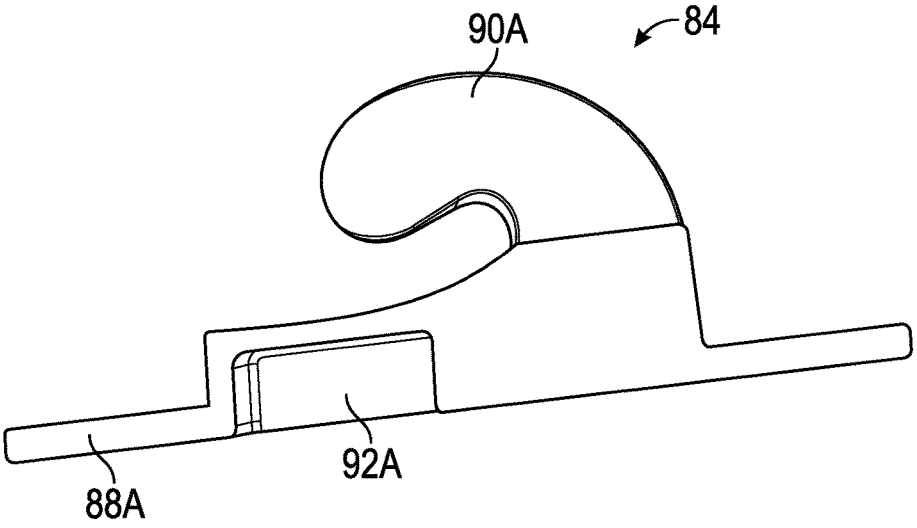
FIG. 6 is a schematic view of a portion of a lace guide.

The upper 16 may be a variety of materials, such as leather, textiles, polymers, cotton, foam, composites, etc. In one example, the upper 16 may be a polymeric material capable of providing elasticity to the upper 16, and may be of braided construction, a knitted (e.g., warp-knitted) construction or a woven construction. The front section 16A is fixed to the forefoot region 20 of the sole structure 12, and more specifically to the midsole 26 to partially define the foot-receiving cavity 33, which is best shown in FIG. 4. More specifically, the foot-receiving cavity 33 is for the forefoot portion 20 and a midfoot portion 22 of a foot, and because the front section 16A is a mule configuration, it also establishes a portion of the foot-receiving cavity at the heel region 24. In the embodiment shown, the front section 16A is configured as a mule, as it extends from the forefoot region 20 to the heel region 24, with a rear periphery 34 extending around the heel region 24 from the lateral side 30 to the medial side 32. A portion of the midsole 26 extends upward and outwardly of the rear periphery 34 of the front section 16A, and also extends from the lateral side 30 to the medial side 32 so that together the rear periphery 34 of the front section 16A and the midsole 26 form a support 38 extending upward at the rear of the midsole 26. In other embodiments, the front section 16A may not extend around the heel region 24, in which case a support functionally equivalent to support 38 is formed by the rear upper edge of the midsole 26. In still other embodiments, a portion of a heel counter secured to an inner or outer surface of the upper may form the support.

Figure 2:
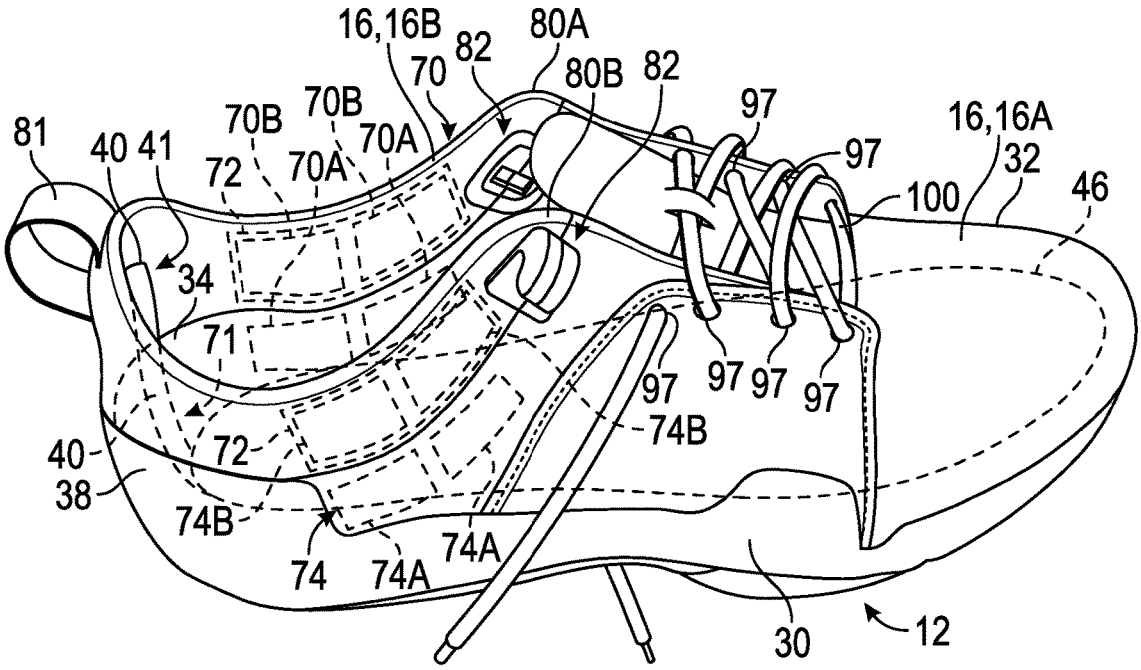
FIG. 2 is a schematic perspective view of the article of footwear of FIG. 1 with the rear section of the upper in a use position.
Figure 3:
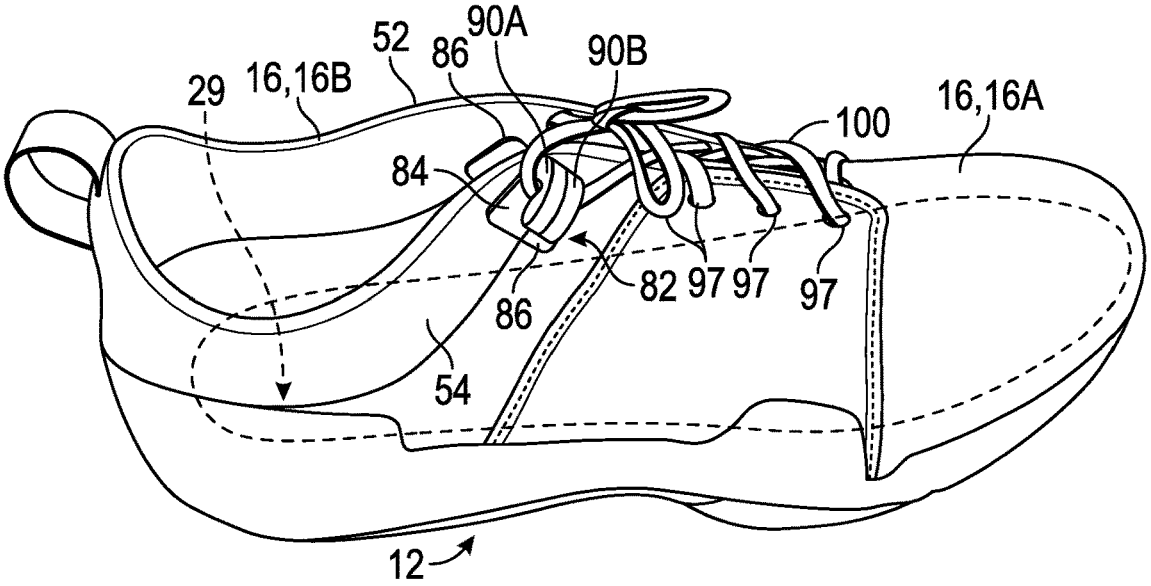
FIG. 3 is a schematic perspective view of the article of footwear of FIG. 2 with a lace further securing the rear section of the upper in the use position.

The rear section 16B is movable relative to the front section 16A between the access position (FIGS. 1 and 4) and the use position (FIGS. 2 and 3). As used herein, movable "between" the access position and the use position means that the rear section 16B may be moved from one of the positions to the other of the positions. The rear section 16B is at least partially rearward of the front section 16A both in the access position and in the use position. In the access position of FIG. 1, the rear section 16B is entirely rearward of the front section 16A. In the use position, the rear section 16B rests on the heel region 24 of the front section 16A as shown in FIG. 2, but is still rearward of most of forefoot and midfoot regions 20, 22 of the front section 16A.

A tether 40 couples the insole 23 to the rear section 16B. For example, the tether 40 may be stitched or otherwise secured to the insole 23 at one end of the tether 40, and to the rear section 16B at the other end of the tether 40. Stitching 42 is indicated in FIG. 1 where the tether 40 is secured to the heel region of the insole 23. The tether 40 is secured to an inner surface 41 of the rear section 16B and is a flexible, elongated structure capable of withstanding a tensile load. The tether 40 may be, for example, a material such as a woven polymer. As used in this application and the accompanying claims, "tether" 40 can comprise any one of, or a plurality of, or any combination of two or more selected from among the following: a strap, a cord, a filament, a strand, a ribbon, a tube, a braid, a strip, a cable, a lace, a belt, a string, a thread, a rope, a wire, and a web. The tether 40 overlays the support 38 when the rear section 16B is in the access position of FIG. 1. The position of the tether along with the weight of the rear section 16B causes the rear 44 of the insole 23 to be lifted from the foot-facing surface 29 of the midsole 26 in the access position. The support 38 acts as a fulcrum over which the tether slides in pulling the rear section 16B from the access position to the use position. As a foot is inserted through the opening of the front section 16A (between the lateral and medial sides 30, 32 of the front section 16A) into the foot-receiving cavity 33, the bottom of the foot engages the insole 23, pushing the insole downward, and possibly sliding the insole 23 forward in the foot-receiving cavity 33, as indicated by the relative position of the foremost extent 46 of the insole 23 in the use position of FIG. 2 relative to the access position of FIG. 1. The tether 40 is inelastic or has an elasticity that is sufficiently low such that any increase in length of the tether 40 when under tension (i.e., stretching of the tether 40) is sufficiently minimal such that the rear section 16B is nevertheless moved to the use position when the tether 40 pulls the rear section 16B, and the insole 23 is nevertheless moved to the lifted position when the tether 40 pulls the insole 23.

The heel region of the insole 23 resists bending when the bottom of the foot engages the insole 23 and moves the insole 23 from the lifted (access) position to a lowered (use) position. For example, a stiffening component 48 may be embedded in, or adhered or otherwise secured to the heel region of the insole 23. The insole 23 has a first stiffness, and the stiffening component 48 has a second stiffness greater than the first stiffness. For example, the stiffening component 48 may be a polymeric composite, a carbon fiber, or other material that is relatively stiff in comparison to the insole 23 which may be a flexible foam material. By reducing flexibility of the lifted insole 23 at least in the heel region, the stiffening component 48 helps ensure that the movement of the insole 23 pulls the tether 40 and thereby moves the rear section 16B. By way of non-limiting example, the stiffening component 48 may be a plate, one or more rods, fins, or mesh secured to or embedded in the insole 23, or a heel cup coupled with the insole 23.

The rear section 16B has a central portion 50 to which the tether 40 is secured, and includes a medial wing 52 and a lateral wing 54, each branching from the central portion 50 so that the rear section 16B is generally U-shaped. The rear section 16B and the front section 16A have a complementary, interfitting shape in that a lower edge 56 of the medial wing 52 and a lower edge 58 of the lateral wing abut a medial edge 60 of the front section 16A and a lateral edge 62 of the front section 16A, respectively, when the rear section 16B is in the use position. The lower edge 64 of the rear section 16B in the central portion 50 also abuts the rear edge 66 of the front section 16A at the rear periphery 34 of the front section 16A. As shown in FIG. 2, the edges 60, 66, 62 are continuous, creating a rim on which the lower edges 56, 64, 58 rest. The lower edges 56, 64, 58 are referred to as "lower" because they are at a bottom of the rear section 16B when the rear section 16B is in the use position.

When a foot is inserted toward and into the foot-receiving cavity 33 through the opening between the edges 60, 62 and is received on the insole 23, the insole 23 slides downwardly and forwardly in the foot-receiving cavity 33, pulling the tether 40 over the support 38 and moving the rear section 16B from the access position to the use position. The tether 40 slides along and over the support 38 and down into the foot-receiving cavity 33, resting against the inner surface 71 of the front section 16A as shown in FIG. 2. In an embodiment, the tether 40 is generally flat and smooth to reduce friction when sliding over the support 38.

The motion of the rear section 16B from the access position to the use position is initiated by the insertion of the foot and the downward and forward forces on the insole 23. However, sets of magnets 70, 74 strategically positioned on the front section 16A and the rear section 16B provide magnetic force that supplement the foot-initiated motion of the rear section 16B, pulling the moving rear section 16B toward the front section 16A once the rear section 16B is sufficiently close to the front section 16A. More specifically, the front section 16A and the rear section 16B include sets of magnets 70, 74 adjacent to (i.e., at or bordering) the interfacing lower edge 56 and medial edge 60, the interfacing lower edge 58 and lateral edge 62, and, optionally the interfacing lower edge 64 and rear edge 66. The magnets are arranged such that the respective ends of the adjacent magnets of the front section 16A and rear section 16B are of opposite polarity, causing the rear section 16B to be magnetically coupled to the front section 16A in the use position. The magnets attract to one another as the rear section 16B moves, beginning with the rearmost ones of the magnets 70A, 74A attracting magnets 70B, 74B, respectively, and progressing forward to more forward sets of paired magnets 70A, 70B and 74A, 74B, in a zipper-like fashion.

For example, as indicated with hidden lines in FIGS. 1, 2 and 4, a medial set of magnets 70 includes front medial magnets 70A secured to or embedded in the medial side 32 of the front section 16A. The medial set of magnets 70 also includes rear medial magnets 70B secured to the medial wing 52. In the embodiment shown, the rear medial magnets 70B are disposed in a magnet housing 72 sewn into or otherwise embedded in the medial wing 52. Similarly, a lateral set of magnets 74 includes front lateral magnets 74A secured to or embedded in the lateral side 30 of the front section 16A. The lateral set of magnets 74 also includes rear lateral magnets 74B secured to the lateral wing 54. In the embodiment shown, the rear lateral magnets 74B are also disposed in a magnet housing 72 sewn into or otherwise embedded in the lateral wing 54. In the embodiment shown, each of the front medial magnets 70A, the rear medial magnets 70B, the front lateral magnets 74A, and the rear lateral magnets 74B include two magnets. In other embodiments, each could include only one magnet, or each could include three or more magnets, or there could be different numbers of magnets amongst the front medial magnets 70A, the rear medial magnets 70B, the front lateral magnets 74A, and the rear lateral magnets 74B.

As best shown in FIGS. 1 and 4, the front medial magnets 70A are disposed at (i.e., adjacent to) the medial edge 60 of the front section 16A, the rear medial magnets 70B are disposed at the lower edge 56 of the medial wing 52, the front lateral magnets 74A are disposed at the lateral edge 62 of the front section 16A, and the rear lateral magnets 74B are disposed at the lower edge 58 of the lateral wing 54. The magnets 70A, 70B, 74A, 74B may be exposed at the respective edges 60, 56, 62, 58, or the material of the front section 16A or rear section 16B in which they are respectively embedded may cover the magnets; in either case, the magnets are positioned to border the respective edges.

Figure 9:
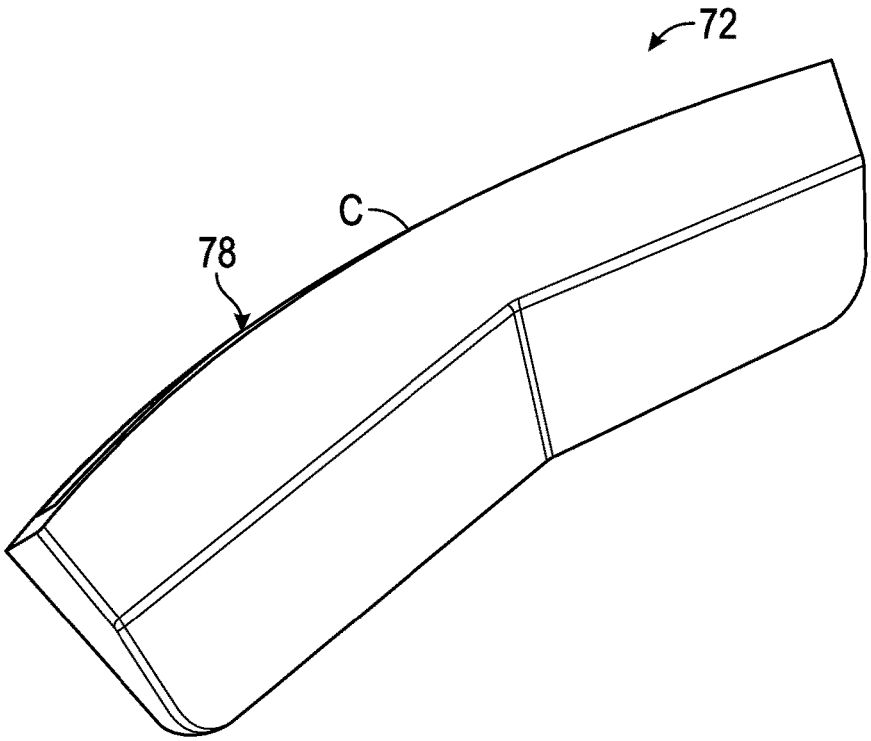
FIG. 9 is a schematic perspective view of a magnet housing for the rear section of FIG. 1.
Figure 10:
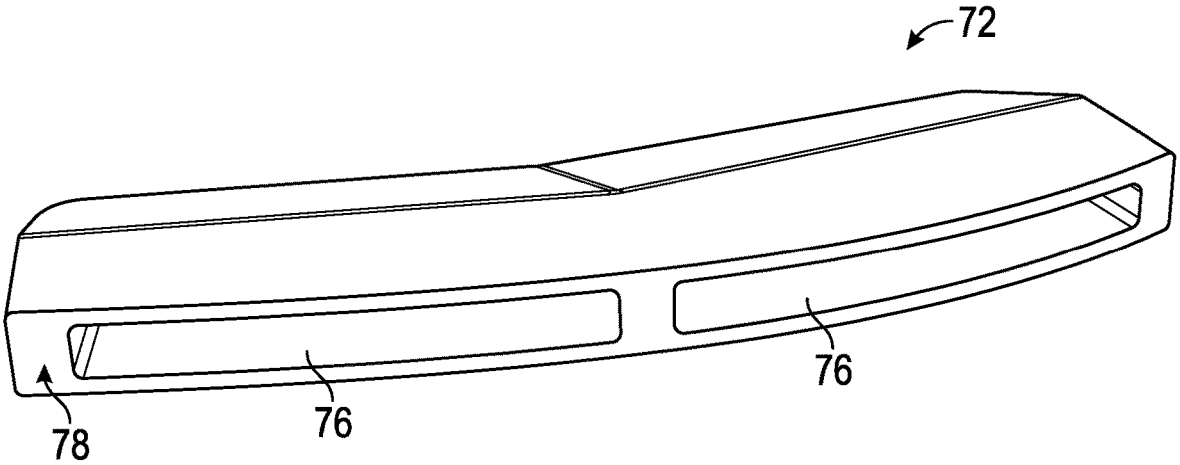
FIG. 10 is a schematic perspective view of the magnet housing of FIG. 9, showing cavities for housing the magnets.

The magnet housing 72 is shown in greater detail in FIGS. 9 and 10. The magnet housing 72 is of a relatively small thickness to fit within the medial and lateral wings 52, 54 of the rear section 16B. The housing 72 defines cavities 76 shown in FIG. 10. The cavities 76 are rectangular slots, and are open at an edge face 78 of the housing 72. The cavities 76 are sized so that the magnets 70B, 74B can be press-fit and/or adhered to the housing 72 in the cavities and retained therein. The edge face 78 is configured with a slightly convex contour C along its length that matches the contour of the edges 56, 60, 58, 62, enabling exposed faces of the magnets at the edge face 78 to closely track the edges 56, 58, which can place the magnets in close proximity to increase the strength of the magnetic force between the magnets 70A, 70B, and between the magnets 74A, 74B.

As shown in FIG. 1, the medial wing 52 and the lateral wing 54 are spaced apart from the sole structure 12 in the access position sufficiently such that the magnets 70A, 70B in the rear section 16B are not pulled toward the magnets 70A, 74A of the front section 16A. A distal end 80A of the medial wing 52 and a distal end 80B of the lateral wing 54 are rearward of the tether 40 in the access position, and forward of the tether 40 in the use position. Stated differently, the tether 40 that is secured to the sliding insole 23 and to the inner surface 41 of the rear section 16B causes the rear section 16B to flip approximately 180 degrees from the access position to the use position. The movement of the rear section 16B may be referred to as articulating movement. In the use position, the medial wing 52 is adjacent to the front section 16A with the rear medial magnets 70B secured to the front medial magnets 70A, and the lateral wing 54 is adjacent to the front section 16A with the rear lateral magnets 74B secured to the front lateral magnets 74A.

Figure 7:
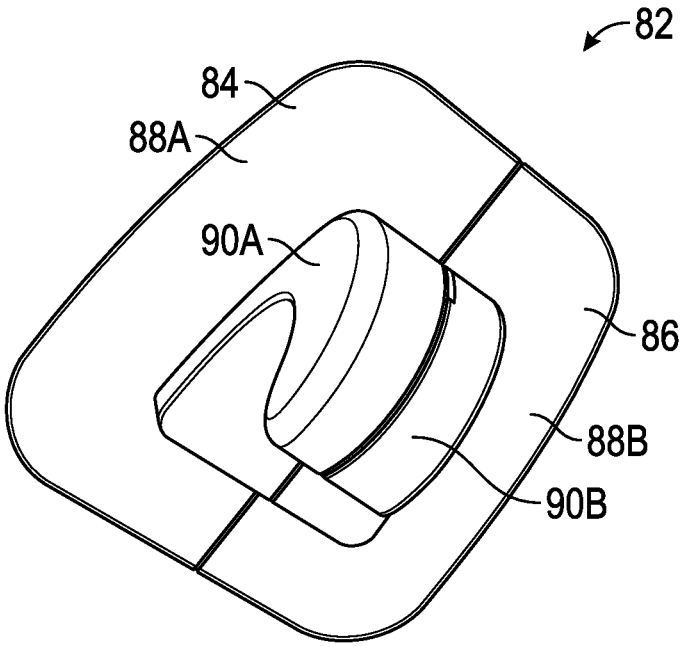
FIG. 7 is a schematic perspective view of a lace guide having two portions adjacent to one another.

While the magnets are selected to be of sufficient magnetic strength to help pull the moving rear section 16B to the use position (as discussed above) and maintain the rear section 16B in the use position during some activities, the magnetic force is also low enough to enable the rear section 16B to be returned to the access position when removal of the footwear 10 is desired by holding the medial and lateral wings 52, 54 near the distal ends 80A, 80B and manually pulling backward, without requiring excessive force. To ensure that the magnetic force is low enough to enable relatively easy removal in this manner while also ensuring the rear section 16B remains in the use position during all user activities, a lace 100 and split lace guides 82 are used to further secure the rear section 16B in the use position. More specifically, the article of footwear 10 includes a split lace guide 82 at each of the medial side 32 and the lateral side 30, as indicated in FIGS. 2 and 4. Each lace guide 82 is split between the front section 16A and the rear section 16B. Stated differently, the lace guide 82 has two discrete portions 84, 86 as best shown in FIG. 7. One of the portions is mounted on and secured to only the front section 16A and not the rear section 16B, and the other portion is mounted on and secured to only the rear section 16B and not the front section 16A. The portions 84, 86 are positioned on a different one of the front section 16A and rear section 16B so that they are adjacent to and in contact with one another when the rear section 16B is in the use position, but are spaced apart from and not in contact with one another (i.e., split) when the rear section 16B is in the access position.

Figure 8:
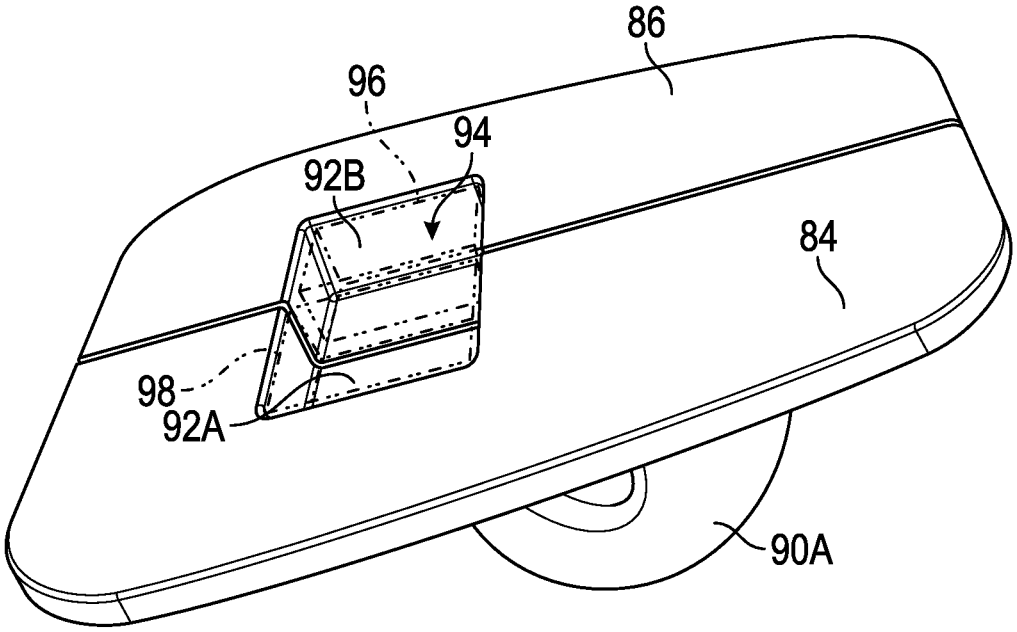
FIG. 8 is schematic perspective view showing magnet cavities in the lace guide of FIG. 7.

Referring to FIGS. 7 and 8, the lace guide 82 has a portion 84 that includes a base 88A and a hook 90A. The lace guide 82 has another portion 86 that includes a base 88B and a hook 90B. Each base 88A, 88B defines a respective cavity 92A, 92B in a mounting side opposite the side with the hook 90A, 90B. As shown in FIG. 8, when the two portions 84, 86 are adjacent to one another, sides of the portions 84, 86 abut so that the cavities 92A, 92B define a continuous cavity 94. A magnet 96 is disposed in the cavity 92A and another magnet 98 is disposed in the cavity 92B. The magnets 96, 98 are shown in phantom in FIG. 8 in order to view the cavities 92A, 92B. The magnet 96 is referred to as the first magnet, and the magnet 98 is referred to as the second magnet of the lace guide 82 that is secured at the medial side 32. An end of the magnet 96 has a polarity opposite from the polarity of an end of the magnet 98. Accordingly, the magnets 96, 98, are attracted to one another, and the magnetic force helps to maintain the lace guide portions 84, 86 together when the rear section 16B is in the use position.

The lace guides 82 are secured to the footwear 10 so that the hooks 90A, 90B point generally downward and rearward in the use position. Accordingly, a first lace guide 82 is disposed with portion 84 secured to the front section 16A and the portion 86 secured to the medial wing 52. The portion 84 is disposed with the cavity 92A open at the edge 60 so that the magnet 98 is exposed at the edge 60, and the portion 86 is disposed with the cavity 92B open at the edge 56 so that the magnet 96 is exposed at the edge 56. The portion 86 is referred to as the first portion and the portion 84 is referred to as the second portion of the lace guide 82 that is secured at the medial side 32.

A second lace guide 82 is secured at the lateral side 30 with the portions arranged so that portion 86 is secured to the front section 16A and the portion 84 is secured to the lateral wing 54. The portion 84 is disposed with the cavity 92A open at the edge 58 so that the magnet 98 is exposed at the edge 58, and the portion 86 is disposed with the cavity 92B open at the edge 62 so that the magnet 96 is exposed at the edge 62. The portion 84 is referred to as the first portion and the portion 86 is referred to as the second portion of the lace guide 82 that is secured at the lateral side 30. The magnet 98 is referred to as the first magnet and the magnet 96 is referred to as the second magnet of the lace guide that is secured to the lateral side 30.

As shown in FIGS. 1 and 2, the front section 16A has a plurality of lace-receiving elements 97 on the front section 16A. The lace-receiving elements 97 are eyelets in the embodiment shown, but could alternatively be hooks or loops. Four lace-receiving elements 97 are shown on the lateral side 30. Four additional lace-receiving elements are positioned on the medial side 32 in a symmetrical arrangement with respect to those on the lateral side 30, but are not visible in the views shown. A lace 100 extends through the lace receiving elements 97. The lace 100 also extends through slits 102 in a tongue portion 104 of the front section 16A to help maintain the tongue portion 104 in a lifted position relative to the sole structure 12, opening the entrance to the foot-receiving cavity 33. When the rear section 16B is in the use position, end segments of the lace 100 protrude from rearmost ones of the lace-receiving elements 97 adjacent to the lace guides 82. The end segments of the lace 100 can be wrapped around the adjacent lace hooks 90A, 90B of the respective medial and lateral lace guides 82, and then pulled tight and secured to one another in a bow or otherwise, as shown in FIG. 3. The lace 100 thus adjusts the tightness of the front section 16A, and further secures the rear section 16B to the front section 16A in the use position via the lace guides 82. To remove the footwear 10, the lace 100 is untied, the end segments are unwrapped from the lace guides 82, and the rear section 16B is returned to the access position by pulling rearward on the medial and lateral wings 52, 54, such as at the distal ends 80A, 80B to simultaneously overcome the magnetic forces of the magnets 70A, 70B, 74A, 74B, and 96, 98. The rearward movement of the rear section 16B will pull the tether 40 which in turn pulls the insole 23 slightly rearward relative to the midsole 26 and upward over the support 38 as the foot is withdrawn from the forward part of the foot-receiving cavity 33. A heel pull 81 can also be used, if the use of manual force is desired, as a convenient place to apply force to move the rear section 16B.

Figure 11:
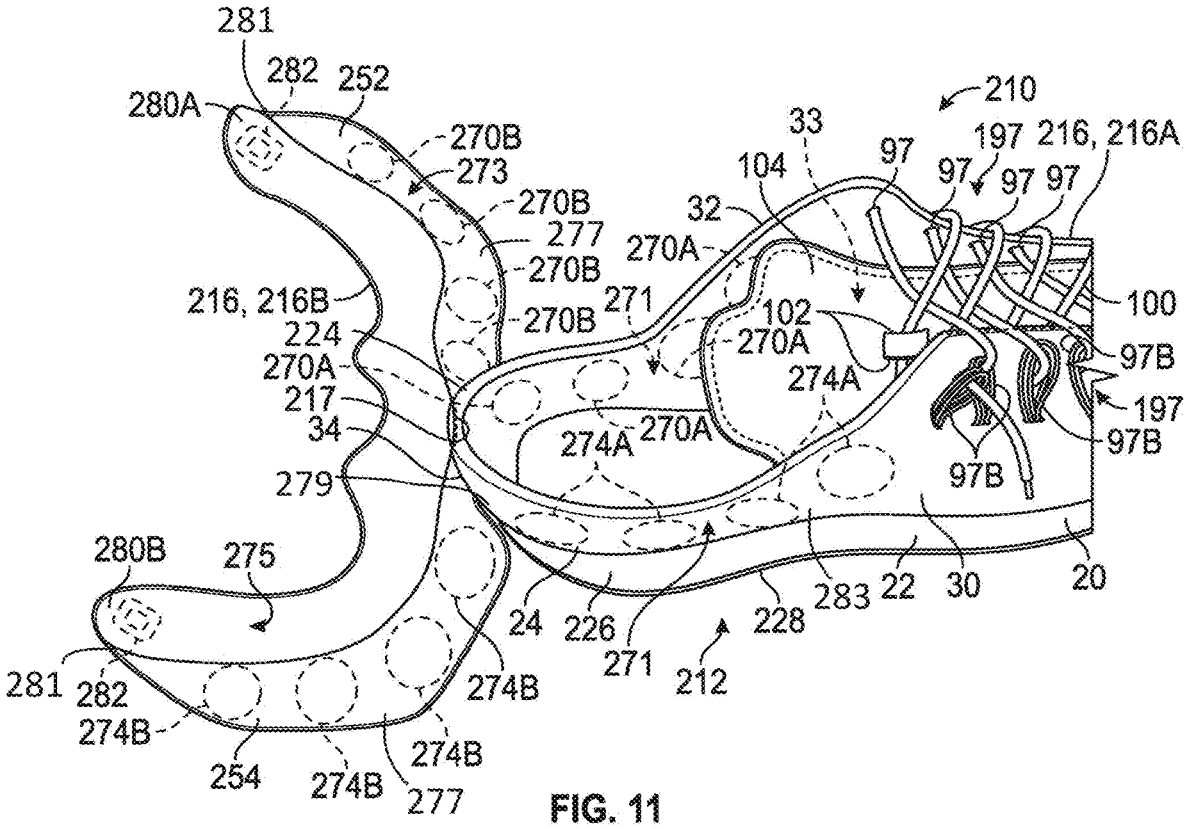
FIG. 11 is a schematic perspective fragmentary view of an article of footwear with a rear section of an upper in an access position, in accordance with an alternative aspect of the present disclosure.
Figure 12:
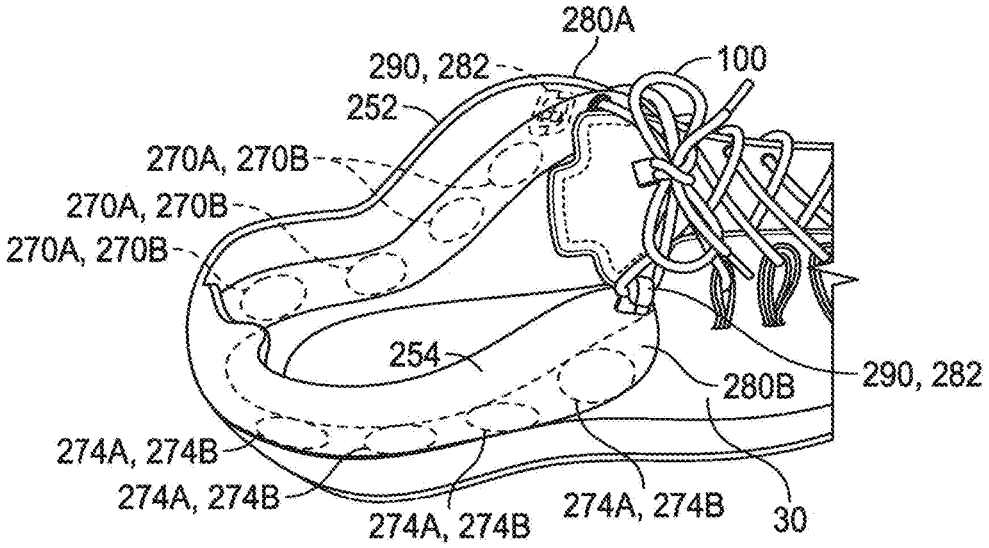
FIG. 12 is a schematic perspective view of the article of footwear of FIG. 11 with the rear section of the upper in a use position.

FIGS. 11-12 show an alternative embodiment of an article of footwear 210 that also has an upper 216 configured to have an easy access position (FIG. 11), and that uses magnetic force to position and retain a rear section 216B of the upper in a use position (FIG. 12) with the rear section 216B articulating relative to the front section 216A from the access position to the use position. The footwear 210 includes a sole structure 212 including a midsole 226 and an outsole 228, configured similarly to the midsole 26 and outsole 28, except that the midsole 226 may or may not have a support similar to support 38. The upper 216 includes a front section 216A and a rear section 216B. FIGS. 11 and 12 also show inward-facing lower surfaces 277 of the medial and lateral wings 252, 254 seating against a rearward-facing outer surface 279 of the rear periphery 34 of the heel region 224 of the upper's front section 216A when the upper's rear section 216B is in the use position. FIGS. 11 and 12 further show distal ends 281 of the inward-facing lower surfaces 277, which are located adjacent terminal ends of the medial and lateral wings 252, 254, seat against respective lateral sides 30 of a midfoot region 283 of the upper's front section 216A. As best seen in FIG. 11, the heel region 224 of the upper's front section 216A is U-shaped and extends continuously around the heel region 24 of the footwear 210. As best seen in FIG. 12, the upper's rear section 216B, when in the use position, is U-shaped and extends continuously around an outer perimeter of the heel region 224 of the upper's front section 216A.

The front section 216A is fixed to the forefoot region 20, the midfoot region 22 and the heel region 24 of the sole structure 212 in a mule configuration, and partially defines a foot-receiving cavity 33. The rear section 216B is operatively secured to the sole structure 212 at least partially rearward of the front section 216A. The rear section 216B is operatively secured to the sole structure 212 via the rear portion of the front section 216A. In the embodiment shown, operative securement of the rear section 216B to the front section 216A is by stitching the rear section 216B to the outer surface of the front section 216A at the rear periphery 34, as indicated by stitching 217.

The rear section 216B includes a medial wing 252 and a lateral wing 254, similar to medial wing 52 and lateral wing 54 of the rear section 16B of FIG. 1. The footwear 210 also includes a medial set of magnets including at least one front medial magnet 270A secured to a medial side 32 of the front section 216A, and at least one rear medial magnet 270B secured to the medial wing 252. The footwear 210 includes a lateral set of magnets including at least one front lateral magnet 274A secured to a lateral side 30 of the front section 216A, and at least one rear lateral magnet 274B secured to the lateral wing 254. The front medial magnets 270A are arranged adjacent to an outer surface 271 of the front section 216A at the medial side 32. For example, the magnets 270A may be embedded in the front section 216A near the outer surface 271 at the medial side 32 or in a cavity formed between inner and outer layers of the front section 216A, or the magnets 270A may be secured directly to the outer surface 271. Similarly, the magnets 274A are embedded in the front section 216A at the lateral side 30 near the outer surface 271 or in a cavity formed between inner and outer layers of the front section 216A, or, alternatively, the magnets 270B may be secured to the outer surface 271. The rear medial magnets 270B are arranged adjacent to an inner surface 273 of the medial wing 252, and the rear lateral magnets 274B are arranged adjacent to an inner surface 275 of the lateral wing 254. For example, the magnets 270B, 274B may be embedded in the rear section 216B near the inner surface 273, may be secured directly to the inner surface 273, or may be in a cavity formed between inner and outer layers of the rear section 216B. The magnets 270A are arranged so that ends of magnets 270A have an opposite polarity than end of magnets 270B to which they are adjacent in the use position. The magnets 274A are arranged so that ends of magnets 274A have an opposite polarity than end of magnets 274B to which they are adjacent in the use position. The magnets 270A, 270B, 274A, and 274B are indicated with hidden lines as having a circular disc shape, but could instead be other shapes.

In FIG. 11, the rear section 216B may be held in the access position shown by holding the wings 252, 254 near distal ends 280A, 280B. When the ends 280A, 280B are no longer held rearward as shown in FIG. 11, the magnets on the rear section 216B will be pulled forward by the magnets on the front section 216A in a zipper fashion, beginning with the rearmost ones of the magnets 270A, 274A attracting the inward-most magnets 270B, 274B (due to their close proximity), moving the remaining magnets 270B, 274B forward to couple to and pair with the similarly spaced magnets 270A, 274A having ends of opposite polarity on both the medial and lateral sides 32, 30 in a zipper-like fashion. The rear section 216B thus articulates relative to the front section 216A between the access position and the use position. In the access position, the medial wing 252 and the lateral wing 254 are spaced apart from the sole structure 212 with a distal end 280A of the medial wing 252 and a distal end 280B of the lateral wing 254 both remote from the sole structure 212 and further apart from one another than in the use position of FIG. 12. In the use position, the distal end 280A of the medial wing 252 is adjacent to the front section 216A with the rear medial magnets 270B coupled to the front medial magnets 270A, and the distal end 280B of the lateral wing 254 adjacent to the front section 216A with the rear lateral magnets 274B coupled to the front lateral magnets 274A. In the use position, the inner surface 273 of the medial wing 252 overlaps the outer surface 271 of the front section 216A at the medial side 32, and the inner surface 275 of the lateral wing 254 overlaps the outer surface 271 of the front section 216A at the lateral side 30. The magnets 270A, 270B, 274A, 274B are spaced so that the faces of the rear magnets 270B, 274B align with the faces of the front magnets 270A, 274A, as indicated by the single sets of circles in hidden lines at each of the lateral and medial sides 30, 32 in FIG. 12. The overlapping surface area of the front magnets 270A, 270B with the rear magnets 274A, 274B is thus maximized.

Similar to the article of footwear 10, the magnets 270A, 270B, 274A, 274B are selected to be of sufficient magnetic strength to help pull the moving rear section 216B to the use position (as discussed above) and maintain the rear section 216B in the use position during some activities, but with the magnetic force low enough to enable the rear section 216B to be returned to the access position when removal of the footwear 210 is desired by holding the medial and lateral wings 252, 254 near the distal ends 280A, 280B and manually pulling backward, without excessive force. To ensure that the magnetic force is low enough to enable relatively easy removal in this manner while ensuring the rear section 216B remains in the use position during all user activities, a lace 100 and lace guides 282 are used to further secure the rear section 216B in the use position. More specifically, the article of footwear 10 includes lace guides 282 secured to the outer surface of the rear section 216B near the distal ends 280A, 280B of the medial wing 252 and the lateral wing 254. Unlike the lace guides 82, the lace guides 282 are not split between the front and rear sections 216A, 216B, but are entirely on the rear section 216B.

As shown in FIGS. 11 and 12, the front section 216A has a plurality of lace-receiving elements 197. The lace-receiving elements 197 include eyelets 97 and loops 97B adjacent to each eyelet at both the lateral and medial sides 30, 32 in a symmetrical arrangement. The loops on the medial side 32 are not visible in the views. A lace 100 extends through the lace-receiving elements 197. The lace 100 also extends through slits 102 in a tongue portion 104 of the front section 216A to help maintain the tongue portion 104 in a lifted position relative to the sole structure 212, opening the entrance to the foot-receiving cavity 33. When the rear section 216B is in the use position, end segments of the lace 100 protrude from rearmost ones of the lace-receiving elements 197 adjacent to the lace guides 282. The end segments of the lace 100 can be wrapped around the lace hooks 290 of the lace guides 282, and then pulled tight and secured to one another in a bow or otherwise, as shown in FIG. 12. The lace 100 thus adjusts the tightness of the front section 216A, and further secures the rear section 216B to the front section 216A in the use position via the lace guides 282. To remove the footwear 210, the lace 100 is untied, the end segments of the lace 100 are unwrapped from the lace guides 282, and the rear section 216B is returned to the access position by pulling rearward on the medial and lateral wings 252, 254, such as at the distal ends 280A, 280B to simultaneously overcome the magnetic forces of the magnets 270A, 270B, 274A, 274B. Withdrawal of the foot rearward from the forward part of the foot-receiving cavity 33 can then be easily accomplished.

Figure 13:
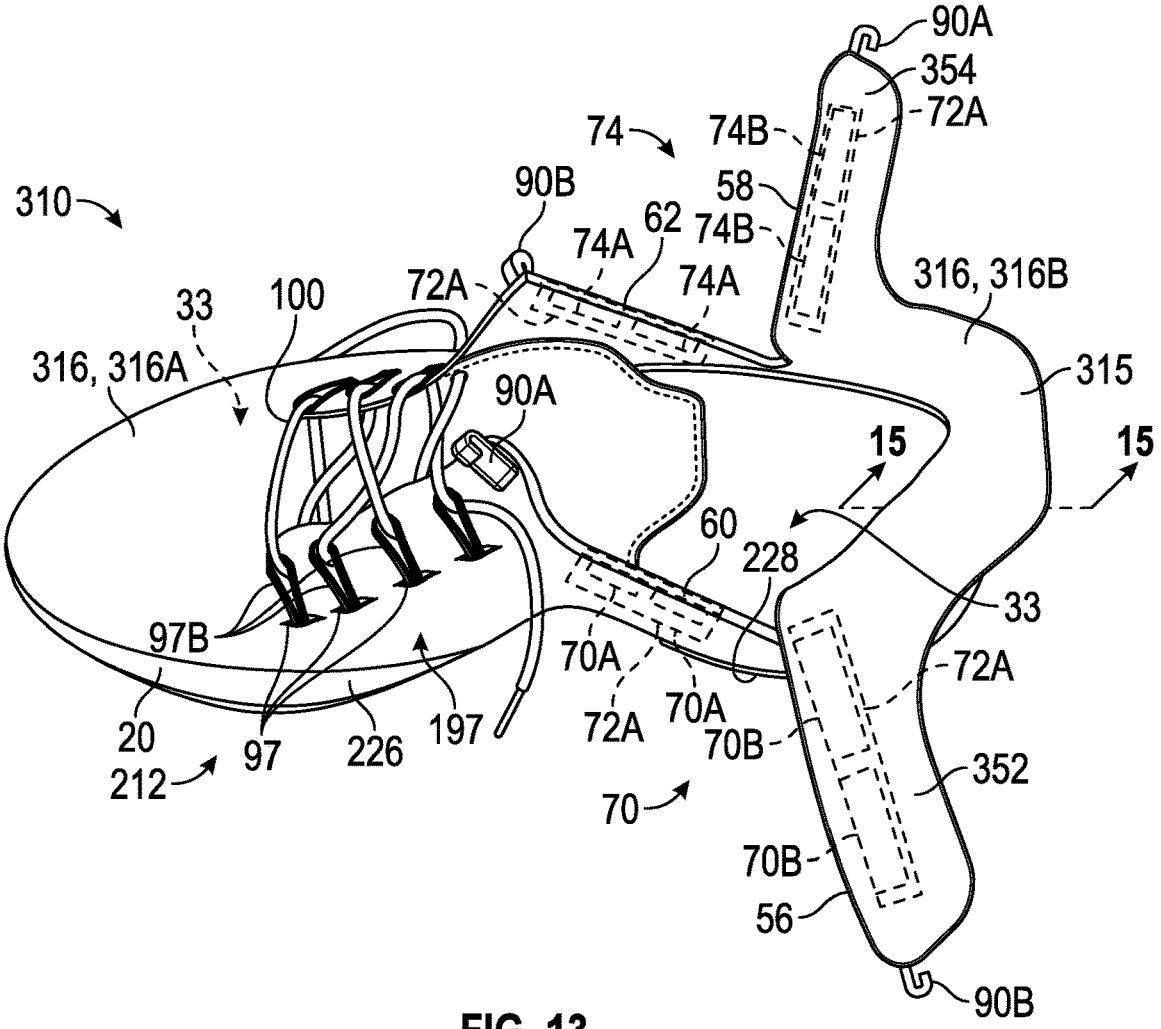
FIG. 13 is a schematic perspective view of an article of footwear with a rear section of an upper in an access position, in accordance with an alternative aspect of the present disclosure.
Figure 14:
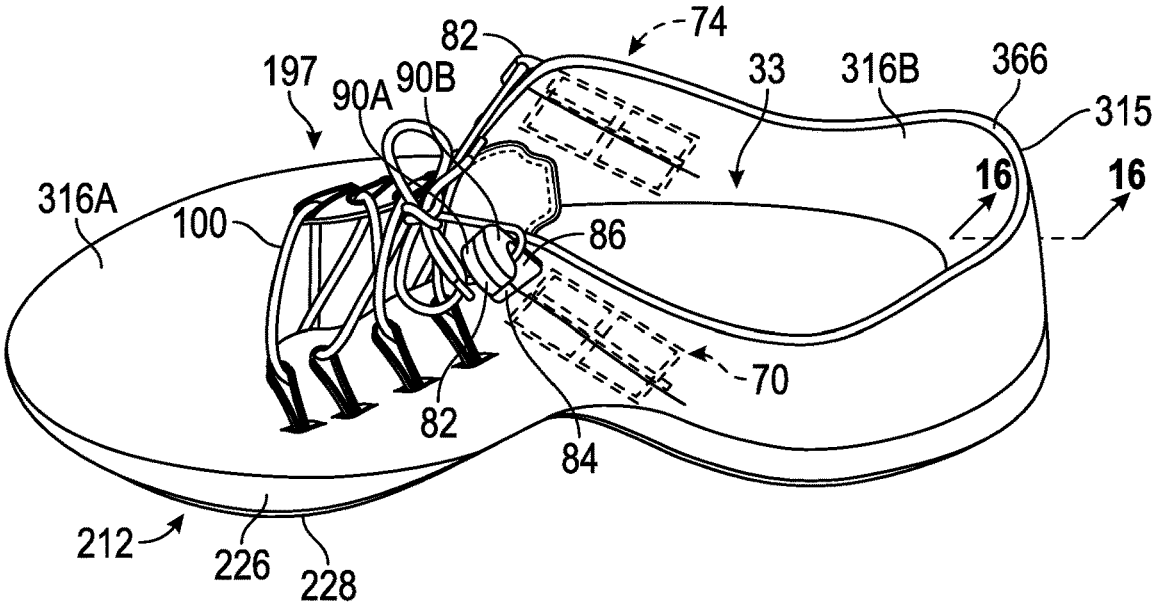
FIG. 14 is a schematic perspective view of the article of footwear of FIG. 13 with the rear section of the upper in a use position.

FIGS. 13-16 show another embodiment of an article of footwear 310 that also has an upper 316 configured to have an easy access position (FIG. 13), and that uses magnetic force to position and help retain a rear section 316B of the upper 316 in a use position (FIG. 14). The article of footwear 316 has a sole structure 212 as described with respect to article of footwear 210, and an upper 316 that includes a front section 316A and a rear section 316B. The front section 316A is fixed to a forefoot region 20 of the sole structure 212 and partially defines a foot-receiving cavity 33. The rear section 316B is operatively secured to the sole structure 212 and is at least partially rearward of the front section 316A. The rear section 316A includes a medial wing 352 and a lateral wing 354.

Figure 15:
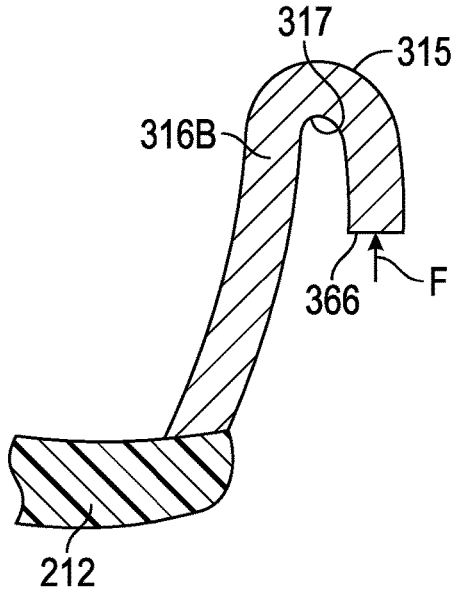
FIG. 15 is a schematic cross-sectional view of the rear section of the upper of FIG. 13, taken at lines 15-15 in FIG. 13.
Figure 16:
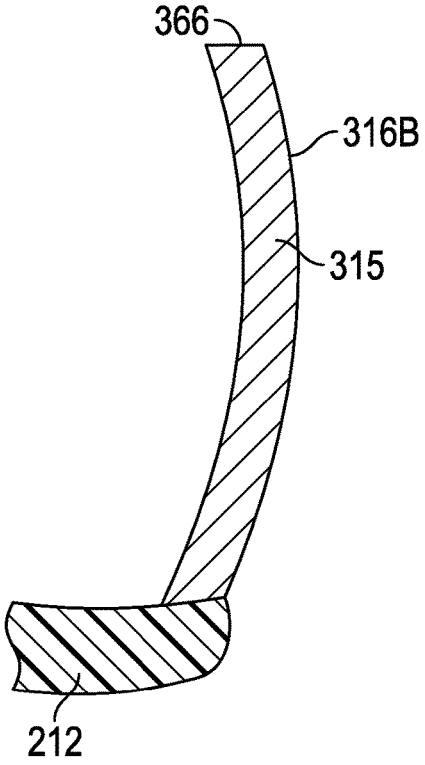
FIG. 16 is a schematic cross-sectional view of the rear section of the upper of FIG. 14, taken at lines 16-16 in FIG. 14.
Figure 17:
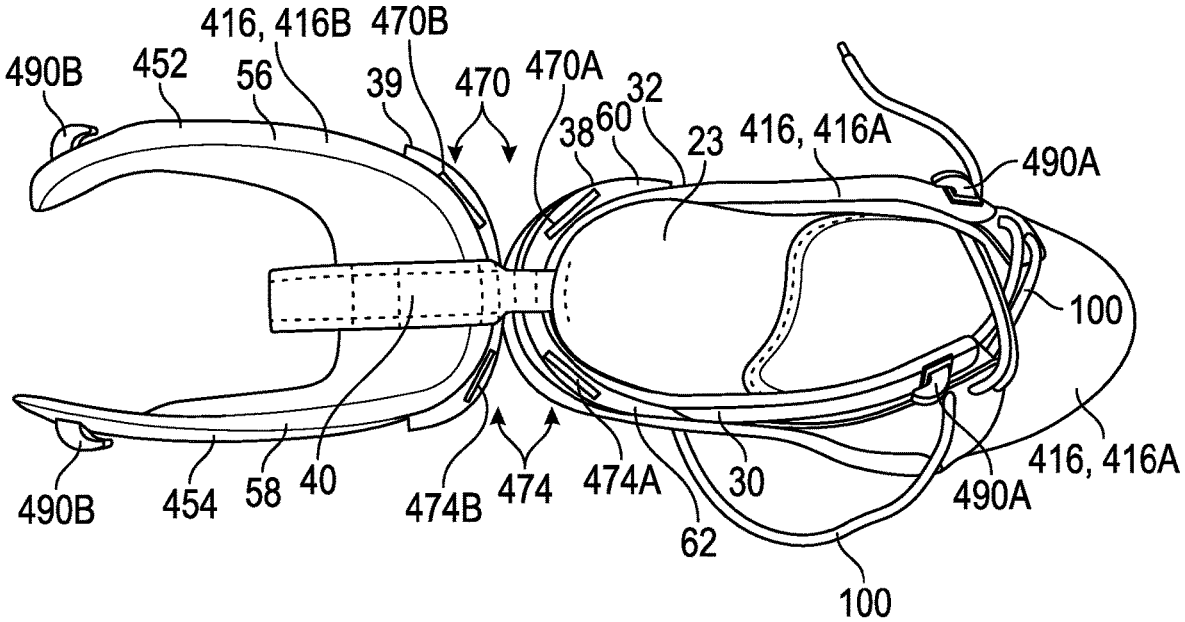
FIG. 17 is a schematic plan view of an embodiment of an article of footwear with a rear section of an upper in an access position, in accordance with an alternative aspect of the present disclosure.

The rear section 316B includes a bistable heel portion 315 with a folded state that establishes the access position, and an unfolded state that establishes the use position. More specifically, the bistable heel portion 315 has a fold 317 between the medial wing 352 and the lateral wing 354 in the folded state as shown in FIG. 15. The fold 317 unfolds when the bistable heel portion 315 moves to the use position. The heel portion 315 has a low stress state when in the folded position of FIGS. 13 and 15, and another low stress state in the unfolded configuration of FIGS. 14 and 16. The heel portion 315 may include a thin plate or band embedded within the material of the rear section 316B that has two stable states (i.e., a relatively bent state and a relatively straightened state) aligned with the folded and unfolded states, respectively.

As indicated in FIG. 15, the folded state moves the edge 366 of the heel portion 315 further rearward relative to the sole structure 212, causing the wings 352, 354 to be relatively widely spread apart and positioned rearward of medial and lateral edges 60, 62 of the front section 316A, as shown in FIG. 13. When moved out of the folded state, such as by applying an upward force F at the edge 366, the heel portion 315 is urged to move to the other stable state, which is the unfolded state. The force F could be applied by the opposite foot of the wearer, for example. When in the unfolded state, the medial and lateral wings 352, 354 are free to move forward, and are urged to do so by a medial set of magnets 70 and a lateral set of magnets 74, as described with respect to FIG. 1, housed in magnet housings 72A similar to magnet housing 72. The magnets are arranged such that ends of adjacent magnets of the front section 316A and rear section 316B are of opposite polarity, causing the rear section 316B to be magnetically coupled to the front section 316A in the use position, beginning with the rearmost ones of the magnets 70A, 74A attracting magnets 70B, 74B, respectively, and progressing forward to more forward sets of paired magnets 70A, 70B and 74A, 74B, in a zipper-like fashion.

The article of footwear 310 includes the lace 100, the lace-receiving elements 197 (include eyelets 97 and loops 97B), and the split lace guides 82 housing magnets 96, 98 as described herein for further securing the rear section 316B in the use position. When in the use position, the lower edge 56 of the medial wing 352 abuts the medial edge 60 of the front section 316A, and the lower edge 58 of the lateral wing 354 abuts the lateral edge 62 of the front section 316A.

Figure 18:
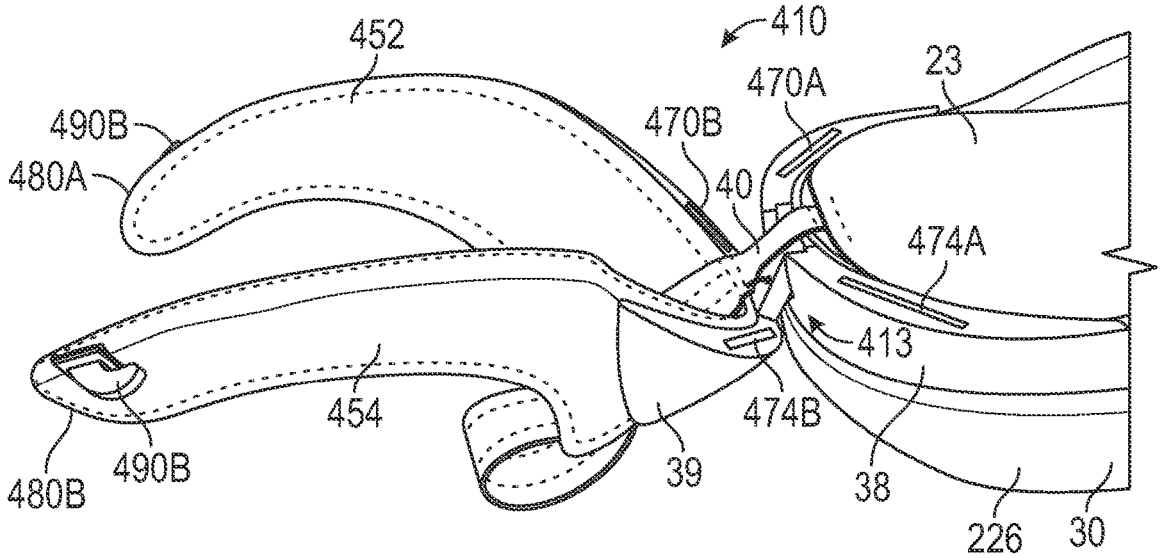
FIG. 18 is a schematic fragmentary perspective view of the article of footwear of FIG. 17 with the rear section of the upper in the access position.
Figure 19:
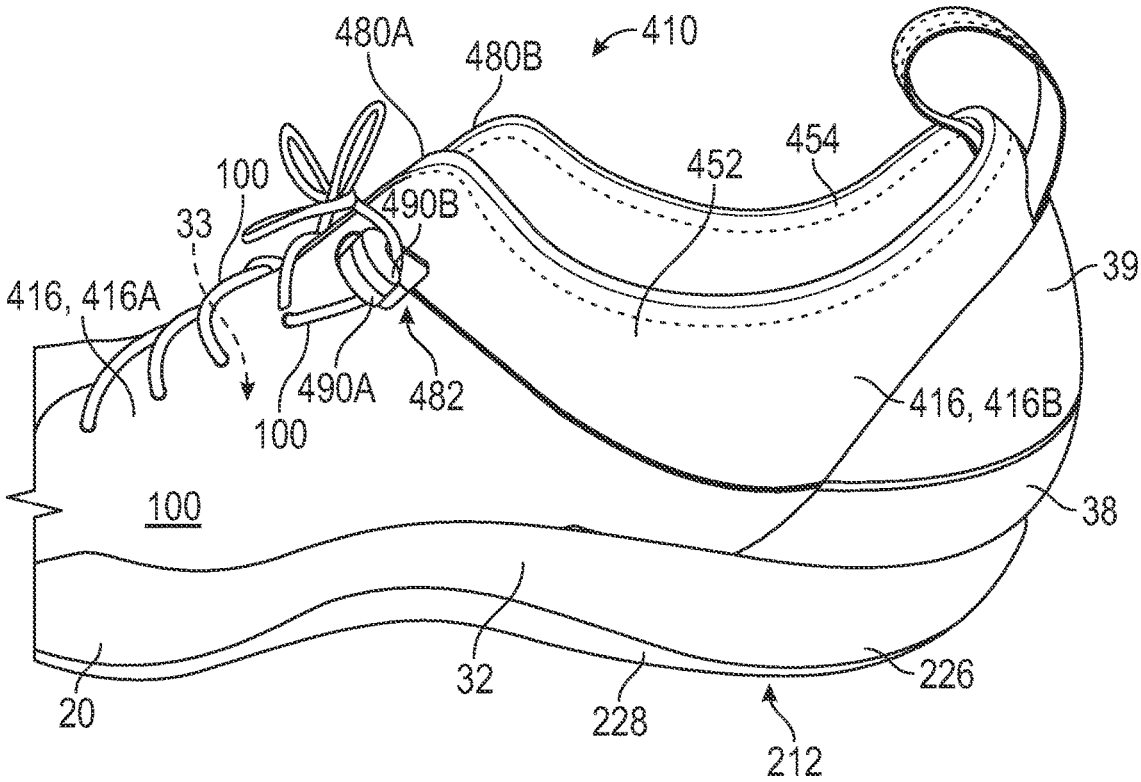
FIG. 19 is a schematic fragmentary perspective view of the article of footwear of FIG. 17 with the rear section of the upper in a use position.
Figure 20:
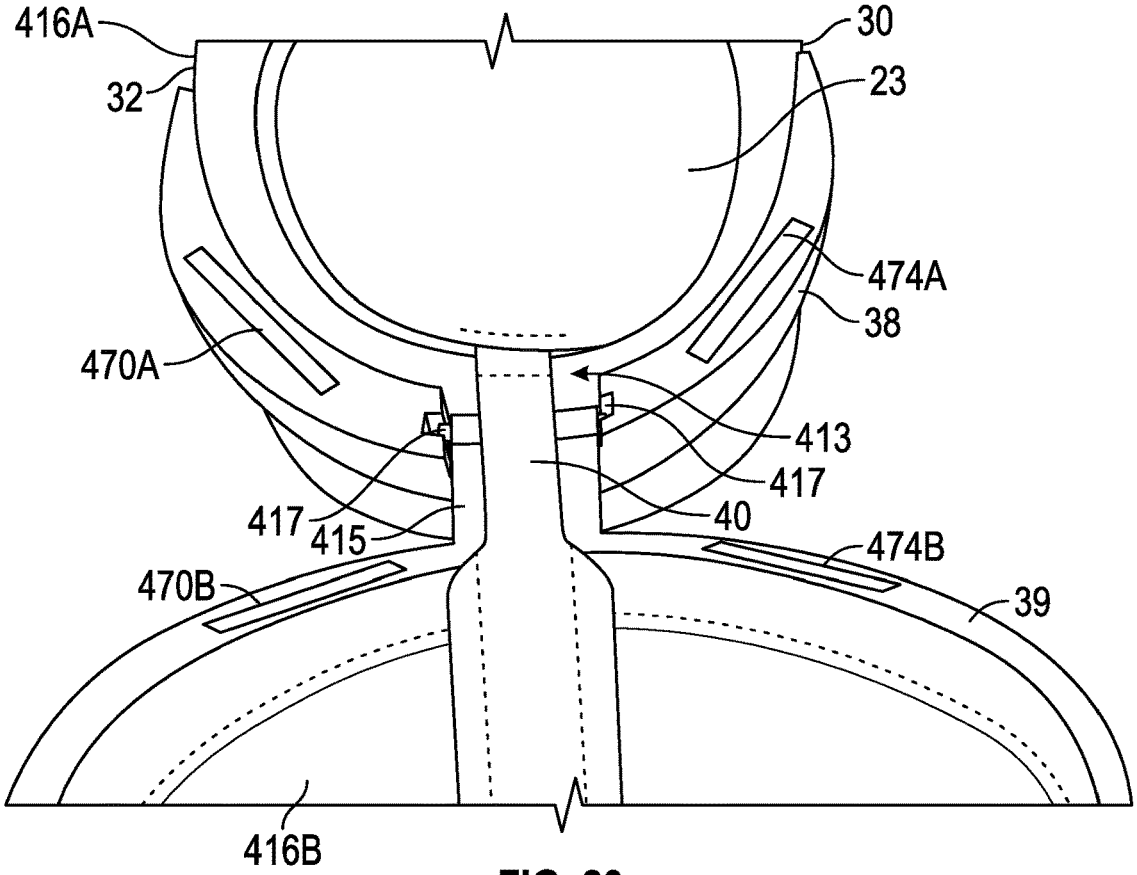
FIG. 20 is a schematic fragmentary plan view of the article of footwear of FIG. 17 with the rear section of the upper in the access position.
Figure 21:
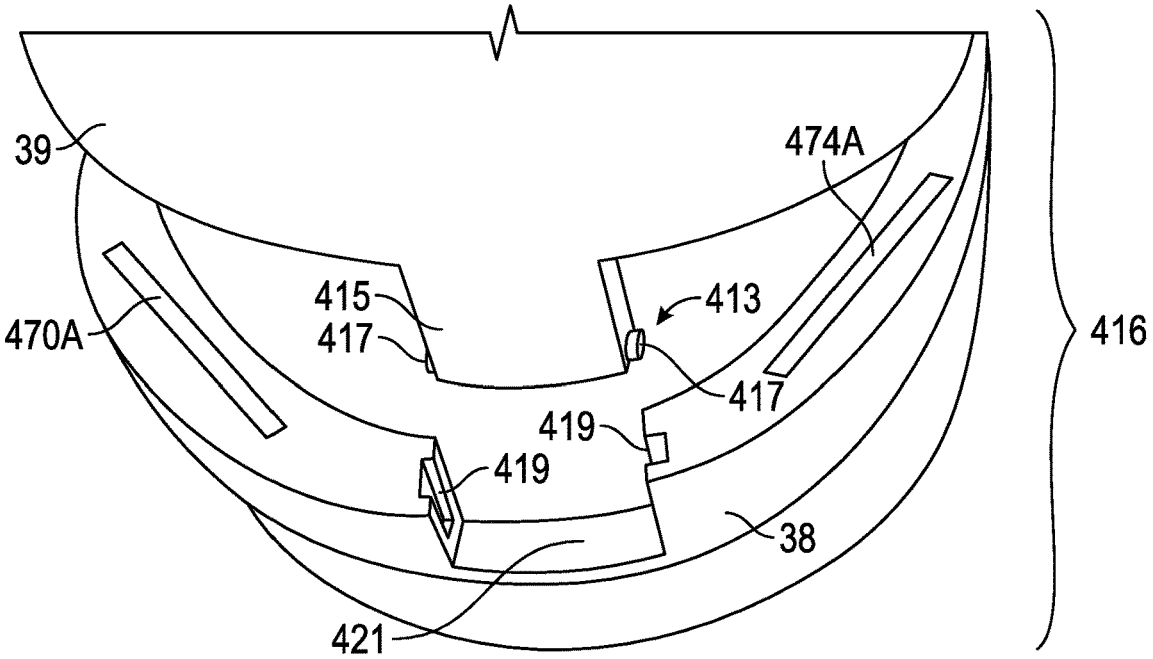
FIG. 21 is a schematic fragmentary exploded rear view of the article of footwear of FIG. 17.

FIGS. 17-21 show another embodiment of an article of footwear 410 that also has an upper 416 configured to have an easy access position (FIGS. 17-18), and that uses an insole 23, a tether 40, and magnetic force to position and help retain a rear section 416B of the upper 416 in a use position (FIG. 19). The article of footwear 416 has a sole structure 212 as described with respect to article of footwear 210, and an upper 416 that includes a front section 416A and a rear section 416B. The front section 416A is fixed to a forefoot region 20 of the sole structure 212 and partially defines a foot-receiving cavity 33. The rear section 416B is operatively secured to the sole structure 212 and is at least partially rearward of the front section 416A. The rear section 416B includes a medial wing 452 and a lateral wing 454.

The front section 416A includes a support 38, and a tether 40 coupled to an inner surface of the rear section 416B and to the insole 23, as described with respect to the tether 40 and insole 23 of FIG. 1. The support 38 is discrete from the outsole 228. The rear section 416B also includes a support 39 secured around a rear periphery of the rear section 416B, and having a portion included in the medial wing 452 and a portion included in the lateral wing 454. The supports 38, 39 may be a stiffer polymer material than the remainder of the upper 416, and may serve as a heel counter.

A hinge 413 connects the rear section 416B to the front section 416A. The hinge 413 includes a hinge plate 415 coupled with the rear section 416B, and a pin 417 that extends outward from the hinge plate 415 and is pivotally mounted to the front section 416A when the ends of the pin 417 are slid into slots 419 formed on either side of a notch 421 in the support 38. The pin 417 may extend through a channel in the hinge plate 415, or the pin 417 may be protrusions integral with and extending from opposite sides of the hinge plate 415. The tether 40 extends across at least a portion of the hinge plate 415 when the rear section 416B is in the access position.

The article of footwear 410 includes a medial set of magnets 470 and a lateral set of magnets 474. The medial set of magnets 470 includes a front medial magnet 470A secured to the medial side of the front section 416A in the support 38, and a rear medial magnet 470B secured to the medial wing 452 in the support 39. The lateral set of magnets 474 includes at least one front lateral magnet 474A secured to a lateral side 30 of the front section 416A, and at least one rear lateral magnet 474B is secured to the lateral wing 454 in the support 39.

The rear section 416B is movable relative to the front section 416A between the access position and the use position. The tether 40 overlays the support 38 in the access position such that a rear of the insole 23 is lifted in the access position as shown in FIG. 18. The insole 23 includes the stiffening component 48 indicated in FIG. 1. The medial wing 452 and the lateral wing 454 are spaced apart from the sole structure 212 in the access position. In the use position, the medial wing 452 is adjacent to the front section 416A with the rear medial magnet 470B coupled to the front medial magnet 470A, and the lateral wing 454 is adjacent to the front section 416A with the rear lateral magnet 474B coupled to the front lateral magnet 474A. The insole 23 slides downwardly and forwardly in the foot-receiving cavity 33 when a foot is received thereon, pulling the tether 40 over the support 38 and moving the rear section 416B from the access position to the use position in an articulating manner.

Split lace guides 482 are secured at the lateral and medial sides of the article of footwear 410. More specifically, first portions 490B of lace guides are secured to the medial wing 452 and to the lateral wing 454, respectively, near distal ends 480A, 480B of the wings 452, 454, and second portions 490A of lace guides 482 are secured to the front section 416A, and. The first portion 490B and the second portion 490A are spaced apart from one another when the rear section 416B is in the access position, and are adjacent to one another when the rear section 416B is in the use position. The lace guides 482 shown do not include magnets, but alternative lace guides 82 as described with respect to FIG. 1 that include complementary magnets as described herein could be used instead. When the first and second portions 490B, 490A are adjacent to one another, the lace 100 can be used to tighten the front section 416A and further secure the rear section 416B in the use position by looping end segments of the lace 100 around the lace guides 482, and tying the end segments together as indicated in FIG. 19.

When in the use position, a lower edge 56 of the medial wing 452 abuts a medial edge 60 of the front section 416A, and a lower edge 58 of the lateral wing 454 abuts a lateral edge 62 of the front section 416A. The at least one front medial magnet 470A is disposed at the medial edge 60 of the front section 416A, the at least one rear medial magnet 470B is disposed at the lower edge 56 of the medial wing, the at least one front lateral magnet 474A is disposed at the lateral edge 62 of the front section 416A, and the at least one rear lateral magnet 474B is disposed at the lower edge 58 of the lateral wing 454. The magnets 470A, 470B couple to one another, and the magnets 474A, 474B couple to one another.

The following Clauses provide example configurations of an article of footwear disclosed herein.

Clause 1: An article of footwear comprising: a sole structure; an upper including a front section and a rear section; the front section fixed to the sole structure and partially defining a foot-receiving cavity, and the rear section rearward of the front section and including a medial wing and a lateral wing; an insole positioned within the foot-receiving cavity; and a tether coupling the insole to the rear section; wherein: the rear section articulates relative to the front section between an access position and a use position; the medial wing and the lateral wing are spaced apart from the front section in the access position; the medial wing is adjacent to the front section and the lateral wing is adjacent to the front section in the use position; a rear of the insole is in a lifted position when the rear section is in the access position; and the insole pulls the tether which moves the rear section from the access position to the use position when the rear of the insole is displaced downward in the foot-receiving cavity relative to the lifted position.

Clause 2: The article of footwear of Clause 1, further comprising: a fastener coupling the front section to the rear section when the rear section is in the use position.

Clause 3: The article of footwear of Clause 2, wherein the fastener comprises: a medial set of magnets including at least one front medial magnet secured to a medial side of the front section and at least one rear medial magnet secured to the medial wing; and a lateral set of magnets including at least one front lateral magnet secured to a lateral side of the front section and at least one rear lateral magnet secured to the lateral wing; wherein the at least one front medial magnet is coupled to the at least one rear medial magnet and the at least one front lateral magnet is coupled to the at least one rear lateral magnet when the rear section is in the use position.

Clause 4: The article of footwear of Clause 3, further comprising: a magnet housing defining at least one cavity; wherein the magnet housing is embedded in the medial wing or the lateral wing, and a respective one of the at least one rear medial magnet and the at least one rear lateral magnet is in the at least one cavity.

Clause 5: The article of footwear of any of Clauses 3-4, wherein: a lower edge of the medial wing abuts a medial edge of the front section in the use position, and a lower edge of the lateral wing abuts a lateral edge of the front section in the use position; the at least one front medial magnet is disposed at the medial edge of the front section, the at least one rear medial magnet is disposed at the lower edge of the medial wing, the at least one front lateral magnet is disposed at the lateral edge of the front section, and the at least one rear lateral magnet is disposed at the lower edge of the lateral wing.

Clause 6: The article of footwear of any of Clauses 1-5, further comprising: a support extending upward at a rear of the sole structure; wherein the tether overlays the support when the rear section is in the access position.

Clause 7: The article of footwear of Clause 6, wherein the support is one or more of a rear periphery of the front section, a rear upper edge of the sole structure, or a portion of a heel counter.

Clause 8: The article of footwear of any of Clauses 1-7, further comprising: at least a first portion of a lace guide secured to the medial wing or the lateral wing.

Clause 9: The article of footwear of Clause 8, further comprising: a second portion of the lace guide is secured to the front section; wherein the first portion and the second portion are spaced apart from one another when the rear section is in the access position and are adjacent to one another when the rear section is in the use position.

Clause 10: The article of footwear of Clause 9, wherein the first portion of the lace guide and the second portion of the lace guide each define a cavity; and the article of footwear further comprising: a first magnet in the cavity of the first portion; and a second magnet in the cavity of the second portion; wherein an end of the first magnet is adjacent to an end of the second magnet when the rear section is in the use position, and the end of the first magnet has a polarity opposite from a polarity of the end of the second magnet.

Clause 11: The article of footwear of any of Clauses 8-10, further comprising: a plurality of lace-receiving elements on the front section; and a lace extending through at least some of the plurality of the lace-receiving elements and around the first portion of the lace guide when the rear section is in the use position.

Clause 12: The article of footwear of any of Clauses 1-11, further comprising: a stiffening component secured to, embedded in, or coupled to a heel region of the insole; wherein the insole has a first stiffness, and the stiffening component has a second stiffness greater than the first stiffness.

Clause 13: The article of footwear of any of Clauses 1-12, wherein: the tether is secured to an inner surface of the rear section; and a distal end of the medial wing and a distal end of the lateral wing are rearward of the tether in the access position and forward of the tether in the use position.

Clause 14: The article of footwear of any of Clauses 1-13, further comprising: a hinge connecting the rear section to the front section.

Clause 15: The article of footwear of Clause 14, wherein the tether extends across the hinge when the rear section is in the access position.

Clause 16: An article of footwear comprising: a sole structure; an upper including a front section and a rear section; the front section fixed to a forefoot region of the sole structure and partially defining a foot-receiving cavity, and the rear section operatively secured to the sole structure at least partially rearward of the front section and including a medial wing and a lateral wing; a medial set of magnets including at least one front medial magnet secured to a medial side of the front section and at least one rear medial magnet secured to the medial wing; and a lateral set of magnets including at least one front lateral magnet secured to a lateral side of the front section and at least one rear lateral magnet secured to the lateral wing; wherein: the rear section is movable relative to the front section between an access position and a use position; in the access position, the medial wing and the lateral wing are spaced apart from the sole structure with a distal end of the medial wing and a distal end of the lateral wing both remote from the sole structure and further apart from one another than in the use position; and in the use position, the distal end of the medial wing is adjacent to the front section with the at least one rear medial magnet coupled to the at least one front medial magnet, and the distal end of the lateral wing is adjacent to the front section with the at least one rear lateral magnet coupled to the at least one front lateral magnet.

Clause 17: The article of footwear of Clause 16, further comprising: at least a first portion of a lace guide secured to the medial wing or the lateral wing.

Clause 18: The article of footwear of Clause 17, further comprising: a second portion of the lace guide secured to the front section; wherein the first portion and the second portion are spaced apart from one another when the rear section is in the access position and are adjacent to one another when the rear section is in the use position.

Clause 19: The article of footwear of Clause 18, wherein the first portion of the lace guide and the second portion of the lace guide each define a cavity; and the article of footwear further comprising: a first magnet in the cavity of the first portion; and a second magnet in the cavity of the second portion; wherein an end of the first magnet is adjacent to an end of the second magnet when the rear section is in the use position, and the end of the first magnet has a polarity opposite from a polarity of the end of the second magnet.

Clause 20: The article of footwear of any of Clauses 17-19, further comprising: a plurality of lace-receiving elements on the front section; and a lace extending through at least some of the plurality of the lace-receiving elements and around the first portion of the lace guide when the rear section is in the use position.

Clause 21: The article of footwear of any of Clauses 16-20, further comprising a magnet housing defining at least one cavity; wherein the magnet housing is embedded in the medial wing or the lateral wing and a respective one of the at least one rear medial magnet and the at least one rear lateral magnet is in the at least one cavity.

Clause 22: The article of footwear of any of Clauses 16-21, wherein: a lower edge of the medial wing abuts a medial edge of the front section in the use position, and a lower edge of the lateral wing abuts a lateral edge of the front section in the use position; the at least one front medial magnet is disposed at the medial edge of the front section, the at least one rear medial magnet is disposed at the lower edge of the medial wing, the at least one front lateral magnet is disposed at the lateral edge of the front section, and the at least one rear lateral magnet is disposed at the lower edge of the lateral wing.

Clause 23: The article of footwear of any of Clauses 16-21, wherein: the at least one front medial magnet is arranged adjacent to an outer surface of the front section, the at least one rear medial magnet is arranged adjacent to an inner surface of the medial wing, the at least one front lateral magnet is arranged adjacent to the outer surface of the front section, and the at least one rear lateral magnet is arranged adjacent to an inner surface of the lateral wing; the inner surface of the medial wing overlaps the outer surface of the front section in the use position; and the inner surface of the lateral wing overlaps the outer surface of the front section in the use position.

Clause 24: The article of footwear of Clause 16, wherein: the rear section of the upper includes a bistable heel portion that has a folded state in the access position and an unfolded state in the use position; the bistable heel portion has a fold between the medial wing and the lateral wing in the folded state, and the fold is unfolded when the bistable heel portion is in the unfolded state.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. As used in the description and the accompanying claims, a value is considered to be "approximately" equal to a stated value if it is neither more than 5 percent greater than nor more than 5 percent less than the stated value. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed:

1. An article of footwear comprising:

a sole structure with adjoining forefoot, midfoot, and heel regions;

a multipart upper defining therein a foot-receiving cavity and including:

a first upper section attached to and extending across the forefoot, midfoot, and heel regions of the sole structure; and a second upper section movably attached via stitching to the first upper section adjacent the heel region of the sole structure, the second upper section including first and second wings configured to wrap around and abut a first heel region of the first upper section;

a first series of magnets attached to the first upper section and extending around the first heel region; and a second series of magnets attached to the second upper section and extending across the first and second wings, wherein the second upper section is movable relative to the first upper section between an access position, whereat the first and second wings and the second series of magnets are spaced from the first heel region and the first series of magnets, and a use position, whereat the first and second wings abut the first heel region of the first upper section and the first series of magnets magnetically couple to the second series of magnets.

2. The article of footwear of claim 1, further comprising:

a lace attached to and configured to tension the first upper section;

a first lace hook attached to the first wing and configured to receive a first portion of the lace to thereby secure the first wing to a first midfoot region of the first upper section; and a second lace hook attached to the second wing and configured to receive a second portion of the lace to thereby secure the second wing to the first midfoot region of the first upper section.

3. The article of footwear of claim 2, wherein the first upper section further includes a plurality of lace-receiving elements, and wherein the lace extends through the plurality of lace-receiving elements to thereby attach to the first upper section.

4. The article of footwear of claim 1, wherein the first series of magnets includes a first plurality of medial magnets located on a medial side of the first heel region and a first plurality of lateral magnets located on a lateral side of the first heel region, and wherein the second series of magnets includes a second plurality of medial magnets located on the first wing and a second plurality of lateral magnets located on the second wing.

5. The article of footwear of claim 4, wherein the second plurality of medial magnets is embedded within the first wing and the second plurality of lateral magnets is embedded within the second wing.

6. The article of footwear of claim 4, wherein the first plurality of medial magnets is arranged in a first medial row and spaced from each other along a length of the footwear, and the first plurality of lateral magnets is arranged in a first lateral row and spaced from each other along the length of the footwear.

7. The article of footwear of claim 1, wherein inward-facing lower surfaces of the first and second wings seat against a rearward-facing outer surface of the first heel region of the first upper section when the second upper section is in the use position.

8. The article of footwear of claim 7, wherein distal ends of the inward-facing lower surfaces located adjacent terminal ends of the first and second wings seat against respective sides of a first midfoot region of the first upper section.

9. The article of footwear of claim 1, wherein the first heel region of the first upper section is U-shaped and extends continuously along the heel region of the sole structure, and wherein the second upper section, when in the use position, is U-shaped and extends continuously around an outer perimeter of the first heel region.

10. The article of footwear of claim 9, wherein a central region of the second upper section is fastened to the first heel region of the first upper section.

11. The article of footwear of claim 1, wherein the first series of magnets is arranged on the first heel region of the first upper section wings and have sufficient magnetic strength to pull the first and second wings with the second series of magnets and the second upper section to the use position.

12. The article of footwear of claim 1, wherein the second upper section further includes a second heel region interposed between and connecting the first and second wings, the second heel region being pivotably mounted to the first heel region of the first upper section such that the second upper section rotates back and forth between the access position and the use position.

13. An upper for an article of footwear, the article of footwear including a sole structure with a forefoot region, a midfoot region, and a heel region, the upper comprising:

a first upper section configured to attach to and extend across the forefoot, midfoot, and heel regions of the sole structure, the first upper section including a first heel region extending continuously around the heel region of the sole structure;

a second upper section movably attached via stitching to the first upper section adjacent the heel region of the sole structure, the second upper section including first and second wings configured to wrap around and abut the first heel region of the first upper section;

a first series of magnets attached to the first upper section and extending around the first heel region; and a second series of magnets attached to the second upper section and extending across the first and second wings, wherein the second upper section is movable relative to the first upper section between an access position, whereat the first and second wings and the second series of magnets are spaced from the first heel region and the first series of magnets, and a use position, whereat the first and second wings abut the first heel region of the first upper section and the first series of magnets magnetically couple to the second series of magnets.

14. A method of assembling an article of footwear, the method comprising:

receiving a sole structure with adjoining forefoot, midfoot, and heel regions;

receiving a multipart upper defining therein a foot-receiving cavity, the multipart upper including a first upper section and a second upper section, the first upper section including a first heel region extending continuously around the heel region of the sole structure;

attaching a first series of magnets to the first upper section such that the first series of magnets extends around the first heel region of the first upper section;

attaching a second series of magnets to the second upper section such that the second series of magnets extends across the first and second wings;

attaching the first upper section to the sole structure such that the first upper section extends across the forefoot, midfoot, and heel regions of the sole structure; and movably attaching the second upper section to the first upper section adjacent the heel region of the sole structure via stitching, the second upper section including first and second wings configured to wrap around and abut the first heel region of the first upper section, wherein the second upper section is movable relative to the first upper section between an access position, whereat the first and second wings and the second series of magnets are spaced from the first heel region and the first series of magnets, and a use position, whereat the first and second wings abut the first heel region of the first upper section and the first series of magnets magnetically couple to the second series of magnets.

15. The method of claim 14, wherein the first series of magnets includes a first plurality of medial magnets located on a medial side of the first heel region and a first plurality of lateral magnets located on a lateral side of the first heel region, and wherein the second series of magnets includes a second plurality of medial magnets located on the first wing and a second plurality of lateral magnets located on the second wing.

16. The method of claim 15, wherein the first plurality of medial magnets is arranged in a first medial row and spaced from each other along a front-to-back length of the footwear, and the first plurality of lateral magnets is arranged in a first lateral row and spaced from each other along the front-to-back length of the footwear.

17. The method of claim 16, wherein the second plurality of medial magnets is embedded within the first wing and the second plurality of lateral magnets is embedded within the second wing.

18. The method of claim 14, wherein inward-facing lower surfaces of the first and second wings seat against a rearward-facing outer surface of the first heel region of the first upper section when the second upper section is in the use position.

19. The method of claim 14, wherein the second upper section further includes a second heel region interposed between and connecting the first and second wings, the second heel region being pivotably mounted to the first heel region of the first upper section such that the second upper section rotates back and forth between the access position and the use position.

* * * * *